US007270923B2

(12) United States Patent
Matsumoto et al.

(10) Patent No.: US 7,270,923 B2
(45) Date of Patent: Sep. 18, 2007

(54) IMAGE FORMING METHOD

(75) Inventors: Yoshiyasu Matsumoto, Hino (JP); Meizo Shirose, Hachioji (JP); Naohiro Hirose, Hachioji (JP); Tatsuya Nagase, Tachikawa (JP); Asao Matsushima, Hino (JP); Shiro Hirano, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 353 days.

(21) Appl. No.: 10/925,328

(22) Filed: Aug. 24, 2004

(65) Prior Publication Data

US 2005/0089779 A1 Apr. 28, 2005

(30) Foreign Application Priority Data

Aug. 28, 2003 (JP) ..... 2003-304316
Aug. 28, 2003 (JP) ..... 2003-304317

(51) Int. Cl.
*G03G 13/01* (2006.01)

(52) U.S. Cl. ..... 430/45; 430/107.1

(58) Field of Classification Search ..... 430/45, 430/47, 107.1

See application file for complete search history.

(56) References Cited

U.S. PATENT DOCUMENTS 6,689,522 B2 * 2/2004 Yamazaki et al. ..... 430/45
7,016,634 B2 * 3/2006 Kitani et al. ..... 399/298
2004/0043316 A1 * 3/2004 Miho et al. ..... 430/108.6

FOREIGN PATENT DOCUMENTS

| | | |
|---|---|---|
| JP | 2001-92173 | 4/2001 |
| JP | 2002-311775 | 10/2002 |
| JP | 2002-372808 | 12/2002 |

OTHER PUBLICATIONS

English Abstract for Japanese Patent Application No. 2001-92173 dated Apr. 6, 2001.
English Abstract for Japanese Patent Application No. 2002-311775 dated Oct. 25, 2002.
English Abstract for Japanese Patent Application No. 2002-372808 dated Dec. 26, 2002.

* cited by examiner

*Primary Examiner*—John L Goodrow
(74) *Attorney, Agent, or Firm*—Cantor Colburn LLP

(57) ABSTRACT

An image forming method for forming a full color toner image by overlaying four color electrostatic image developing toners of black, yellow, magenta and cyan, wherein at least one of the four color electrostatic image developing toners is a toner containing a large diameter external additive in a larger amount and at least one is a toner containing the large diameter external additive in a smaller amount, in which the primary particle diameter of the large diameter external additive is from 150 nm to 2,000 nm, the content of the large diameter external additive in the toner containing the large diameter external additive in larger amount is from 0.06% by weight to 4.0% by weight and the content of the large diameter external additive in the toner containing the large diameter external additive in the smaller amount is not more than 0.05% by weight.

20 Claims, 3 Drawing Sheets

FIG. 1 ( a )
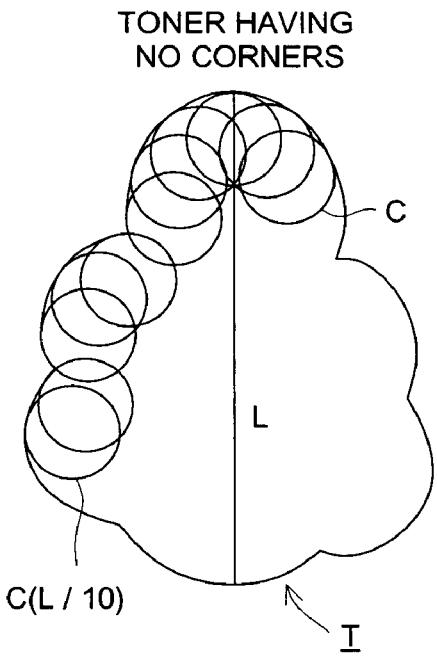
FIG. 1 ( b )
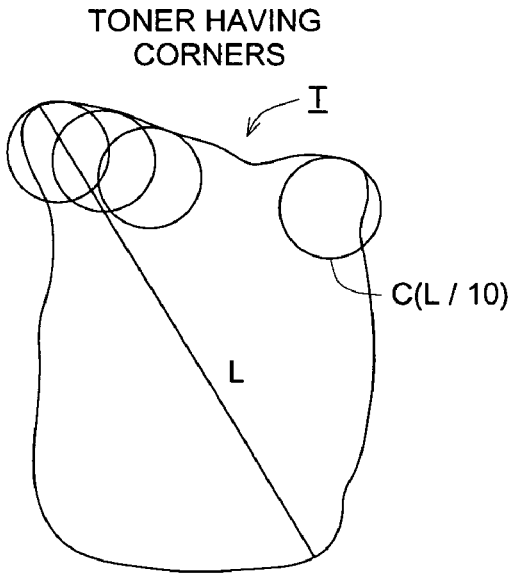
FIG. 1 ( c )
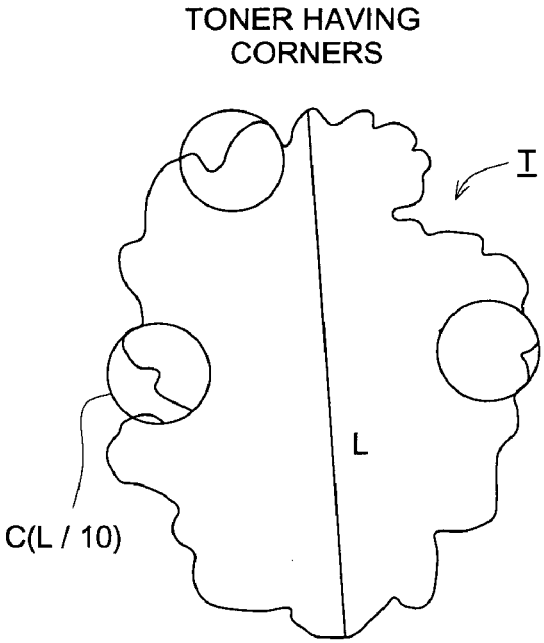

IMAGE FORMING METHOD

FIELD OF THE INVENTION

The present invention relates to an image forming method for forming a full color toner image employing four color toners of yellow, magenta, cyan and black.

TECHNICAL BACKGROUND

Recently, ones utilizing a digital system are noted in the technology of image formation by electrophotography. For example, a dot image formed by small dots on 1200 dpi level (dpi is the number of dot per inch) can be finely reproduced by employing a toner having a small diameter of several micrometers order.

It has been made possible to form a beautiful full color toner image by the use of color toners of yellow, magenta, cyan and black, which is no way inferior to a silver salt photographic image. There is a great need for reproducing a high precision digital image with high fidelity. A technique is applied as one of the countermeasures corresponding to the requirement, in which such the need is satisfied by controlling the physical properties of the toner to satisfy.

For example, there is a technique in which a composite oxide compound of strontium titanate having an average primary particle diameter of from 300 nm to 5400 nm is added as an external additive to a black toner to be used for forming an image. (For example, refer patent publication No. 3).

The purpose of the prior technique is to prevent filming and to raise the visible glossiness by addition of an external additive having large diameter to a polymerized toner. In concrete, a smaller amount of the large diameter external additive is added to the black toner and a larger amount of the additive is added to the other color toners.

It is found, however, that the following problems are caused by the addition of the large diameter external additive.

(a) Lowering in the reproducibility of the second color (b) Lowering in the fixing ability on the folded line (c) Occurrence of filming and fault in cleaning on the occasion of printing of a black document image (characters image)

Solution of the above problems caused by the use of the large diameter external additive is demanded in the present field of the technology.

In the formation of the full color image, the consumption of the toner is larger compared with the formation of a monochromatic image because of high printing area ratio. Consequently, the probability of that the toner is employed to development just after supplied to the developing device is raised. Besides, a compact size printer is popular with customers, and need for a compact size printer not occupying excessive space is high. Therefore, it is inevitable to miniaturize the size of the developing device.

Consequently, a property is required to the toners for full color image formation that the toners can rapidly obtain the sufficient charging ability for employing the image formation after the supplement into the developing device.

As a method for satisfying the above requirement, a technique has been disclosed that a slipping agent such as zinc stearate is added for accelerating the rising up of the charging ability of the toner so as to prevent the fogging of image at the initial period of the use of the toner and the dirt on the apparatus caused by the scatter of the toner (for example, cf. patent publication 1).

Moreover, a technique has been disclosed that the slipping agent is added in a same amount for each of spherical toner particles of yellow, magenta, cyan and black to provide the same slipping ability to each or the toner for improving the cleaning property of the toners (for example, cf. patent publication 2).

It is found, however, that the color image tends to be made white turbidity without clarity when the image is formed by the use of the color toner containing the slipping agent since the fusion between the toner particles is hindered on the occasion of the fixation of the toner transferred onto a recording medium.

Particularly, the degradation in the color reproducibility of the secondary color formed by the plural kinds of the toner tends to be considerable.

It is supposed that such the problem is caused by that the fusing ability of the toner at the fixation is hindered because the slipping agent added to the toner has higher melting point than that of the toner particle.

[Patent Publication 1] Japanese Patent Publication Open to Public Inspection, hereinafter referred to as Japanese Patent O.P.I. Publication, No. 2001-92173 (cf. Paragraph 0009)

[Patent Publication 2] Japanese Patent O.P.I. publication No. 2002-311775 (cf. Paragraphs 0084-0085)

[Patent Publication 3] Japanese Patent O.P.I. publication No. 2002-372808

SUMMARY OF THE INVENTION

The object of the invention is to provide an image forming method in which the charging of the toner can be raised up in short duration after supplying to the developing device and a clear full color image can be obtained.

The object of the invention is to provide an image forming method in which the color reproducibility of the secondary color of the image after fixing and the fixing ability at the folding line are excellent and the formation of filming is inhibited.

It is noted by the inventors that the formation method of the full color image is carried out by overlaying four color toners on an image carrying member and is supposed that the probability of forming the image by directly contacting to the image carrying member is different in the toners from each other.

It is considered that when the toners are overlaid in the order of yellow, magenta and cyan, the amount of the toner directly adhered on the surface of the image carrying member is decreased in the order of yellow, magenta and cyan.

It is found that a clear full color image without the white turbidity can be obtained by using the toners each containing different amount of the slipping agent, in which the amount of the external additive, particularly the slipping agent, is varied according to the probability of the direct contact of the toner to the image carrier surface.

In the invention, the four color toners include a toner containing 0% by weight of the external additive, particularly the slipping agent, and it is also found that a clear beautiful image without fogging can be obtained when such the set of the toners is employed for forming the image.

An outline of the invention is described below.

An image forming method for forming an image by overlaying four color toners of yellow, magenta, cyan and black for developing an electrostatic latent image, in which at least one of the four color toners contains a large diameter external additive in an larger amount, and al least one of the four color toners contains the large diameter external additive in a smaller amount, and the primary particle diameter of the large diameter of the external additive is from 150 nm to 2,000 nm and the external additive content of the toner containing larger amount of the additive is from 0.06% to 4.0% by weight, and the external additive content of the toner containing smaller amount of the additive is not more than 0.05% by weight.

The primary particle diameter of the large diameter external additive is preferably from 280 nm to 1,500 nm.

The large diameter external additive is preferably an inorganic particle, a resin particle or an inorganic-organic composite particle.

The toner containing the large diameter external additive in a smaller amount is preferably the magenta toner or the cyan toner.

The toner containing the large diameter external additive in a larger amount is preferably the yellow toner or the black toner.

The image forming method for forming an image by overlapping four color toners of yellow, magenta, cyan and black for developing a static latent image, in which at least one of the four color toners contains a slipping agent in an larger amount, and al least one of the four color toners contains the slipping agent in a smaller amount, and the slipping agent content of the toner containing larger amount of the slipping agent is from 0.03% to 0.4% by weight, and the slipping agent content of the toner containing smaller amount of the slipping agent is from 0 to 0.02% by weight.

The toner containing the slipping agent in a smaller amount is preferably the yellow toner or the black toner.

The toner containing the slipping agent in a larger amount is preferably the yellow toner or the black toner.

The toner containing the slipping agent in a larger amount is preferably the yellow toner.

The four color toners each preferably contain no magnetic material.

The spherical degree of the toner is preferably from 0.94 to 0.99.

The full color toner image is preferably formed by the method in which the toner images are each formed on each of the photoreceptors and the toner images are each transferred on an intermediate transfer member and then the images transferred on the intermediate layer are transferred on a recording material so as to overlay the images.

BRIEF DESCRIPTION OF THE DRAWINGS

FIG. 1(*a*) shows a projection image of a toner particle having no corner and FIGS. 1(*b*) and 1(*c*) each show a toner particle having a corner.

DESCRIPTION OF THE INVENTION

Figure 2:
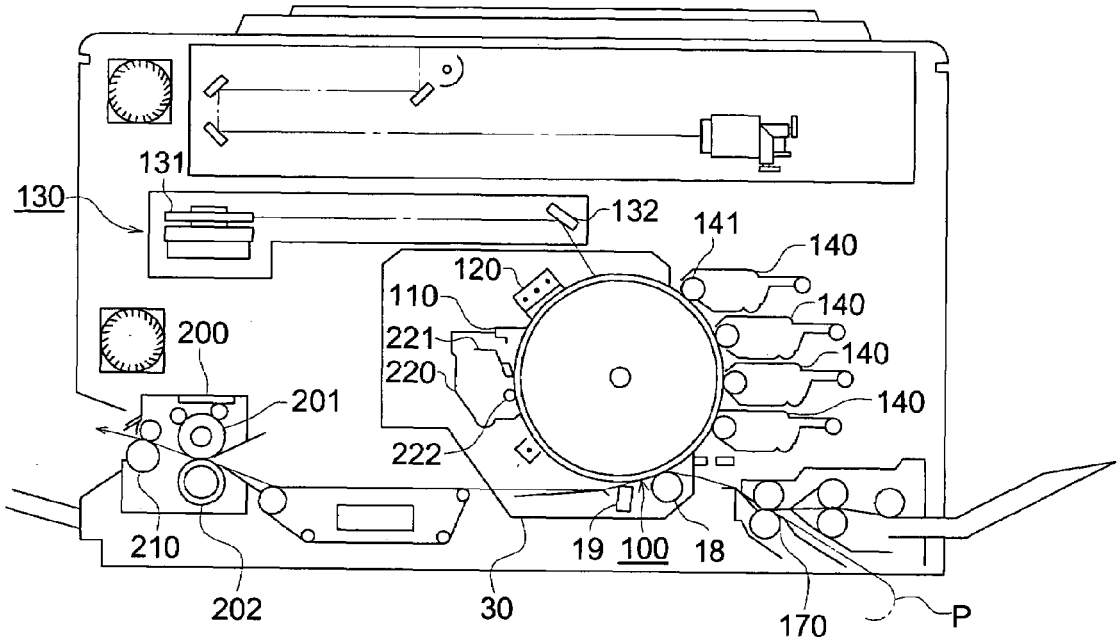
FIG. 2 shows a cross section of an example of image forming apparatus relating to the invention.

An image forming method can be provided by the invention, in which the charging of the toner can be raised up in short duration after supplying to the developing device and a clear full color image can be obtained.

An image forming method can be provided by the invention, in which the color reproducibility of the secondary color of the image after fixing and the fixing ability on the folding line are excellent and the formation of filming is inhibited. Moreover, the effects described in the invention such as the improvement in the reproducibility of the secondary color and the fixing ability on the folding line can be further enhanced.

Regarding the problems of lowering in the reproducibility of the secondary colors and in the fixing ability on the folding line, it is considered as follows by the inventors. Such the problems are particularly important problems relating to the addition of the large diameter external additive among the problems to be solved in the invention.

The large diameter external additive has no thermal plastic property different from the mother particle of the toner or the binder resin of the toner. It is found that the fixing ability tens to be lowered when the large diameter external additive having a large particle diameter and no thermal plasticity is added additionally to the small diameter external additive having a primary particle diameter of from 10 nm to 30 nm.

Such the tendency is made considerable when the thickness of the toner layer to be fixed is increased by overlaying the yellow, magenta, cyan and black toners.

In concrete, the problem on the reproducibility of the secondary color is caused by hindering the fusion and permeation of the toners by the presence of the large diameter external additive on the occasion of formation of the secondary color by the fusion and permeation of the toners each different in the color thereof.

Regarding the fixing ability on the folding line, it is the problem that the thick toner layer of the color image is come off from the folded line of the image when the image is folded for binding as the cover of a pamphlet or French binding, or a A3 size image is folded in Z-shape for binding together with A4 size paper sheets. Moreover, the diameter of the toner is made smaller for corresponding to the requirement of improvement in the image quality. The fixing ability of the toner particle having small diameter is insufficient since the contact area between the small diameter toner and the image recording material becomes small. Consequently the problem of the insufficiency of the fixing ability is made serious.

Furthermore, there is a problem relating the variation in the using environment of the color image forming apparatus. Hitherto, the color copying machine is an apparatus simply for copying a color image. Recently, however, the case in which a high speed color copying machine is connected with a network is increased in the office and the color copying machine is also used as a monochromatic printer for outputting a black and white character image.

Accordingly, it is found that locally presence of the large diameter external additive for supporting the cleaning property, polishing the image carrier and the transferring ability in a toner to be largely consumed typically such as the black toner is effective to maximally display such the effects.

For example, it is found that the large diameter external additive is released from the toner particle and accumulated in the cleaning device and sufficiently displays the functions thereof without any side effect when the large diameter external additive functions as the cleaning aid, the polishing agent and the slipping agent. The black toner is frequently used for a fine line image such as a character image and the transfer ratio thereof tends to be lowered. However, such the problem is solved by the addition of the large diameter external additive and the advantages can be obtained, such as that the reproducibility of the secondary color by the color toners and the fixing ability on the folded line are improved. Moreover, the occurrence of filming on the photoreceptor is inhibited and the cleaning property is also made sufficient. It is investigated in the field of the present technology to make small the difference of the physical properties between the four color toners. In the invention, however, the further stable image forming method is constituted based on the reversal idea.

From another viewpoint, a clear full color image excellent in the reproducibility of the secondary color without white turbidity can be formed by employing four color toners each contain different amount of the slipping agent from each other. A clear and beautiful full color image without fogging caused by insufficient charging of the toner can be constantly obtained since the four color toners each contain the slipping agent and the charging can be rapidly raised even though the amounts of the slipping agent in the toners are different from each other.

Moreover, the clear and beautiful full color image can be obtained as above-mentioned and the suitable cleaning property can be displayed even when the toners are almost true sphere having a spherical degree of from 0.94 to 0.99.

In the invention, as above-described, the lucid and clear full color image formed by the toners can be formed by the use of the color toners in which the adding amounts of the slipping agent are different from each other.

The constituting elements relating to the invention are each described below.

<<Large Diameter External Additive>>

In the invention, the full color toner image is formed by overlapping four color electrostatic image developing toners of yellow, magenta, cyan and black.

At least one of the four color electrostatic image developing toners is a toner containing a large diameter external additive in a larger amount and at least one of the others is a toner containing the large diameter external additive in a smaller amount, the primary particle diameter of the large diameter external additive is from 150 nm to 2,000 nm, the content of the large diameter external additive in the toner containing the large diameter external additive in a larger amount is from 0.06% by weight to 4.0% by weight and the content of the large diameter external additive in the toner containing the large diameter external additive in a smaller amount is not more than 0.05% by weight.

The primary particle diameter of the large diameter external additive is preferably from 150 nm to 2,000 nm and preferably from 280 nm to 1,500 nm.

The external additive content in the toner containing the large diameter additive in the larger amount is preferably from 0.08% to 3.0% by weight, and more preferably from 0.10% to 2.2% by weight.

The external additive content in the toner containing the large diameter additive in the smaller amount is preferably not more than 0.03% by weight, and more preferably from 0% to 0.02% by weight.

As the large diameter external additive relating to the invention, an inorganic particle, a resin particle (also referred to as an organic particle) and an inorganic-organic composite particle are preferably employed. These particles are concretely described below.

<Inorganic Particle>

As the inorganic particle, metal oxides such as magnesium oxide, calcium oxide, titanium oxide, zirconium oxide, tin oxide, aluminum oxide, silicon oxide (silica), indium oxide, beryllium oxide, lead oxide and bismuth oxide; nitride such as boron nitride, aluminum nitride and silicon nitride; and carbide such as silicon carbide and boron carbide are employable.

The above inorganic particles may preferably be subjected to a hydrophobilizing treatment by a hydrophobilizing agent such as a titanium coupling agent, a silane coupling agent, and an aluminum coupling agent or a high molecular weight fatty acid.

<Organic Particle>

As the organic particle, for example, a particle of silicone resin, polyterafluoroethylene, polyvinylidene fluoride, polyethylene trifluorochloride, polyvinyl fluoride, copolymer of ethylene tetrafluoride and perfluoroalkyl vinyl ether, copolymer of ethylene tetrafluoride and propylene hexafluoride, copolymer of ethylene and ethylene trifluoride, copolymer of ethylene tetrafluoride, propylene hexafluoride and perfluoroalkyl vinyl ether, polyethylene, polyvinyl chloride, metal stearate, polymethyl methacrylate and melamine are employable.

<Inorganic-Organic Composite Particle>

The inorganic-organic composite particle is, for example, may be a particle formed from an inorganic particle and an organic particle united with together so that the particle are not separated in the image forming method according to the invention, and the kind and the constitution thereof are not specifically limited. As the composite particle, one may be employed, which is formed by polycondensation of alkoxysilane, aluminum alkoxide or titanium alkoxide in the presence of a polymer particle such as polystyrene or polymethyl methacrylate so as to bond polysiloxane on the particle surface.

A slipping agent of a metal salt of higher fatty acid may be employed.

The polycondensation product may be directly bonded with the polymer particle by a functional group of the polymer particle or bonded through a silane-coupling agent.

A silica particle or an alumina particle may be employed in place of the alkoxysilane. Such the particle may be held by tangling with the siloxane or chemically bonded with the polymer particle by a functional group of the particle such as a hydroxyl group.

A particle may be employed, which is formed by electostatically bonding of an inorganic particle with an organic particle different from each other in the ζ-potential thereof in an aqueous dispersion.

(Slipping Agent)

The slipping agent relating to the invention is described below.

At least one of the four color electrostatic image developing toners of yellow, magenta, cyan and black is a toner containing the slipping agent in a larger amount and at least one is a toner containing slipping agent in a smaller amount, and the content of the slipping agent in the toner containing the slipping agent in the larger amount is from 0.03 to 0.4% by weight and the content of the slipping agent in the toner containing slipping agent in the smaller amount is from 0% to 0.02% by weight. The toner having the slipping agent content of 0% may be used.

The content of the slipping agent can be measured by energy dispersive X-ray spectroscopy (EDX) or wavelength dispersive X-ray spectroscopy (WDX). High precision analysis can be performed by the use of a calibration curve prepared by analyzing the toners each containing a designated amount of the subjective slipping agent.

(Toner Containing the Larger Amount of Slipping Agent)

The toner containing the larger amount of the slipping agent is preferably the yellow or black toner, and most preferably the yellow toner.

(Toner Containing a Smaller Amount of Slipping Agent)

The slipping agent content in the toner containing the smaller amount of slipping agent is most preferably 0. The toner containing the smaller amount of the slipping agent is preferably the magenta or cyan toner, (Concrete Examples of Slipping Agent)

Concrete examples of the slipping agent include a metal salt of higher fatty acid. The concrete examples of such the metal salt of higher fatty acid are metal stearates such as zinc stearate, aluminum-stearate, magnesium stearate and calcium stearate; metal oleates such as zinc oleate, manganese oleate, iron oleate, copper oleate and magnesium oleate; metal palmitates such as zinc palmitate, copper palmitate, magnesium palmitate and calcium palmitate; metal linoleates such as zinc linoleate and calcium linoleate; and metal recinoleates such as zinc recinoleate and calcium recinoleate.

The slipping agent can be added to the toner in the same manner as in the addition of the external additive later-mentioned. Various kind of mixing means such as a tabular mixer, Henschel mixer, tauner mixer and V-type mixer are usable.

<<Production Method of the Electrostatic Image Developing Toner>>

The production method of the electrostatic image developing toner relating to the invention is described below.

The toner to be employed in the invention is preferably one produced by the following procedure: composite resin particles are prepared in the presence of no colorant; a dispersion of colorant particles is added to the dispersion of the composite resin particles; and the composite resin particles and the colorant particles are slated out, coagulated and fused to form the toner particles.

As above-mentioned, the preparation of the composite resin particle is performed without presence of the colorant. Consequently, the polymerization reaction for forming the composite resin particles is not hindered. Therefore, the anti-offset ability of the toner is not degraded and the occurrence of the contamination of the fixing device and the image can be effectively prevented.

Moreover, no monomer or oligomer remains in the obtained toner particles since the polymerization reaction for obtaining the composite resin particle is surely performed. Consequently, occurrence of bad odor in the thermal fixing process of the image forming method can be prevented or reduced.

Furthermore, an image excellent in the sharpness can be formed for a prolonged period since the surface properties of thus obtained toner particles are uniform and the charging property of the particles is sharp.

The composite resin particle is a resin particle having a multi-layered structure which is composed of a core resin particle and one or more layers covering the core particle each composed of resins different from the resin of the core particle in the molecular weight and/or the composition.

The "central portion (core)" of the composite particle is the core particle constituting the composite resin particle.

The "outerlayer (shell)" of the composite resin particle is the outermost layer among the one or more covering layers.

The "intermediate layer" of the composite resin layer is the layer formed between the central portion (core) and the outer layer (shell).

A multi-step polymerization method is preferably applied for obtaining the composite resin particle from the viewpoint of control of the molecular weight distribution for making sure the fixing strength and the anti-offset ability. The "multi-step polymerization method" for obtaining the composite resin particle is a method in which a monomer is polymerized in the presence of resin particle obtained by polymerization of another monomer to form a polymer on the surface of the resin particle so that the covering layer different from the resin constituting the resin particle in the dispersion state and/or the composition is formed. Plural layers can be formed by repeating the polymerization.

One resin particle layer covering the core resin particle is formed by the two-step polymerization method and more covering layers are formed by three- or more-step polymerization.

Plural kinds of resin different from each other in the composition and/or the molecular weight exist in the composite resin particle obtained by the multi-step polymerization method. Therefore, the scatter of the composition, molecular weight and the surface properties between the individual toner particles is narrow in the toner obtained by salting out, coagulating and fusing the composite resin particle and the colorant particle.

By such the toner comprising toner particles each having the uniform composition, molecular weight and the surface property, the anti-offset and the anti-winding properties can be improved while maintaining the suitable adhesive ability (high fixing strength) to the image support in the image forming methods including the fixing process by the contact heating method.

An example of the production method of the electrostatic image developing toner includes the followings:

(1) A multi-step polymerization process in which composite resin particle is produced by the multi-step polymerization method so as to be contained a parting agent and/or crystalline polyester in an area (the central portion or the intermediate layer) other than the outermost layer.

(2) A salting out, coagulating and fusing process for obtaining the toner particle by salting out, coagulating and fusing the composite resin particles and the colorant particles.

(3) A filtration and washing process for separating the toner particles from the dispersion system and removing a surfactant from the toner particles by filtering and washing.

(4) A drying process for drying the washed toner particles.

(5) An adding process for adding the external additive to the dried toner particles.

The each of the processes is described below.

<<Multi-Step Polymerization Process>>

The multi-step polymerization process is a process for producing the composite particle by two- or more-step polymerization. It is preferable to employ the three- or more-step polymerization from the viewpoint of the stability of the production and the strength to crushing of the resulted toner.

The two-step polymerization method and the three-step polymerization method are described below as the typical examples of the multi-step polymerization method.

<<Description of the Two-Step Polymerization Method>>

The two-step polymerization method is a method for producing the composite resin particle constituted by the central portion (core) composed of high molecular weight resin and the outer layer (shell) composed of low molecular weight resin. Namely, the composite resin particle obtained by the two-step polymerization method is constituted by the core and one covering layer.

In concrete, a parting agent is dissolved in a monomer, and resulted monomer solution is dispersed in an aqueous medium (an aqueous solution of a surfactant) in a state of oil droplets, and then the system is subjected to polymerization treatment (the first step polymerization) to prepare a dispersion of high molecular weight resin particles containing the parting agent.

After that, a polymerization initiator and a monomer for obtaining the low molecular weight resin are added to the resulted resin particle dispersion and the monomer is polymerized (the second step polymerization) so as to form a covering layer of the low molecular weight resin on the surface of the resin particle.

<<Description of the Three-Step Polymerization Method>>

The three-step polymerization method is a method for forming the composite resin layer constituted by a central portion (core) composed of high molecular weight resin, the intermediate layer containing the parting agent and the outer layer (shell) composed of low molecular weight resin. Namely, the composite resin particle obtained by the three-step polymerization method is constituted by the core and the two covering layers.

In concrete, a dispersion of the resin particles obtained by an ordinary polymerization treatment (the first step polymerization) is added to an aqueous medium (an aqueous solution of a surfactant), and a monomer solution composed of a monomer and a parting agent dissolved in the monomer is dispersed in the aqueous medium in a state of oil droplets; thus resulted system is subjected to a polymerization treatment (the second step polymerization) to form a covering layer (intermediate layer) composed of resin (polymer of the monomer) containing the parting agent. Thus a dispersion of composite resin particles (high molecular weight resin/low molecular weight resin) is prepared.

Thereafter, a polymerization initiator and a monomer for forming a low molecular weight resin are added to thus obtained dispersion, and the monomer is subjected to polymerization treatment (the third step polymerization) to form a covering layer composed of the low molecular weight resin (polymer of the monomer) on the surface of the composite resin particle.

On the occasion of the formation of the covering layer on the resin particle in the three-step polymerization method, the parting agent can be finely and uniformly dispersed by the procedure in which the dispersion of the resin particle is added to the aqueous medium and the monomer solution is dispersed into oil droplets in the medium, and the then system is subjected to the polymerization treatment (the second step polymerization).

The addition of the resin particle dispersion and the oil droplet dispersion of the monomer solution may be performed in any order or simultaneously.

(a) On the occasion of the formation of the intermediate layer constituting the composite resin particle, the resin particle to be form the central portion (core) of which the parting agent is dissolved in the monomer and the resulted monomer solution is dispersed into the state of oil droplets in the aqueous medium, and then the system was subjected to the polymerization treatment to obtain in a form of latex particle.

The "aqueous medium" is a medium composed of from 50 to 100% by weight of water and from 0 to 50% by weight of a water-soluble organic solvent. Examples of the water-soluble organic solvent are methanol, ethanol, isopropanol, butanol, acetone, methyl ethyl ketone and tetrahydrofuran. Alcohol type solvents are preferable which can not dissolve the obtained resin.

As a suitable method for forming the resin particle or the covering layer each containing the parting agent, a method is applicable, in which the monomer solution composed of the monomer and the parting agent dissolved in the monomer is dispersed into the state of oil droplets by applying mechanical energy in the aqueous medium containing the surfactant in a concentration of less than the critical micelle concentration to prepare a dispersion, and then a water-soluble polymerization initiator is added to the resulted dispersion so that the monomer is polymerized in the droplet by radical polymerization (hereinafter referred to as a mini-emulsion method). An oil-soluble polymerization initiator may be added in place of or together with the water-soluble polymerization initiator to the monomer solution.

By the mini-emulsion method, the parting agent dissolved in the oil phase is not released, different from the usual emulsion polymerization method, and a sufficient amount of the parting agent can be introduced into the resin particle or the covering layer.

The dispersing machine for dispersing the oil droplets by the mechanical energy is not specifically limited, for example, a stirring apparatus Clearmix, manufactured by M-Technique Co., Ltd., having a high speed rotating rotor, a ultrasonic dispersing apparatus, a mechanical homogenizer, Manton-Gourin homogenizer and a pressing homogenizer are usable. The diameter of the dispersed particle is from 10 nm to 1,000 nm, preferably from 50 nm to 1,000 nm, and more preferable from 30 nm to 300 nm.

Usual methods such as an emulsion polymerization method, a suspension polymerization method and a seed polymerization method are also applicable for forming the resin particle or the covering layer each containing the parting agent. These polymerization methods may be applied for obtaining the resin particle (core particle) or the covering layer constituting the composite resin particle each containing no parting agent.

The particle diameter of the composite resin particle obtained by the polymerization process I is preferably from 10 nm to 1,000 nm in terms of weight average diameter measured by an electrophoretic light scattering photometer ELS-800, manufactured by Otsuka Electronics Co., Ltd.

The glass transition point Tg of the composite resin particle is preferably from 48° C. to 74° C., and more preferably from 52° C. to 64° C. The softening point of the composite resin particle is preferably from 95° C. to 140° C.

<<Salting Out, Coagulating and Fusing Process>>

The salting out, coagulating and fusing process is a process to form an irregular-shaped (non-spherical) toner particle by salting out, coagulating and fusing the composite resin particles and the colorant particles.

In the salting out, coagulating and fusing process, internal additive particles (fine particles having a number average particle diameter of from 10 nm to 1,000 nm) such as a charge controlling agent may be salted out, coagulated and fused together with the composite resin particles and the colorant particles.

The colorant particle may be modified on the surface thereof.

The colorant particle is brought into the salting out, coagulating and fusing process in a state of dispersion in an aqueous medium. As the aqueous medium in which the colorant particles are dispersed, an aqueous solution of a surfactant in a concentration more than the critical micelle concentration (CMC) is useful.

A surfactant the same as that employed in the multi-step polymerization I can be used in the above-mentioned.

The dispersing machine for dispersing treatment of the colorant particle is not specifically limited, for example, the stirring apparatus Clearmix, manufactured by M•Technique Co., Ltd., having the high speed rotating rotor, a ultrasonic dispersing apparatus, a mechanical homogenizer, Manton-Gourin homogenizer and a pressing homogenizer, and a medium type dispersing machine such as Geltzman mill and diamond fine mill are usable.

It is preferable for salting out, coagulating and fusing the composite resin particles and the colorant particles to add a coagulation agent in an amount for making a concentration more than the critical coagulation concentration to the dispersion in which the composite resin particles and the colorant particles, and to heat the dispersion by a temperature more than the glass transition point Tg.

It is more preferable to employ a coagulation stopping agent at the time when the diameter of the composite particle is attained at the designate value. A mono-valent metal salt, particularly sodium chloride, is preferably employed as the coagulation stopping agent.

A suitable temperature suitable for the salt out, coagulation and fusion is from (Tg+10° C.) to (Tg+50° C.), and particularly preferably from (Tg+15° C.) to (Tg+40° C.). A water-permissible organic solvent may be added for enhancing the fusion.

As the coagulating agent on the occasion of the salt out, coagulation and fusion, an alkali metal salt and an alkali-earth metal salt are employable.

The salt out and the coagulation in the invention are described below.

The "salt out, coagulation and fusion" is a phenomenon in which the salting out (coagulation of particles) and the fusion (disappear of interface between particles) are simultaneously progressed or an action by which the salting out and the fusion are raised simultaneously.

It is preferable for simultaneously occurring the salt out and the fusion that the particles (the composite resin particle and colorant particle) are coagulated at a temperature not less than the glass transition point Tg of the resin constituting the composite resin particle.

The toner for developing an electrostatic image relating to the invention is preferably produced by the forming composite resin particle in the presence of no colorant, and adding the dispersion of the colorant particles to the dispersion of the composite resin particles, and then salting out, coagulating and fusing the composite resin particles and the colorant particles.

The polymerization reaction is not hindered when the production of the composite resin particle in the system in containing no colorant. Consequently, the excellent anti-offset property is not vitiated and the contamination of the fixing device or the image caused by the accumulation of the toner is not induced.

As a result of that, the polymerization reaction for obtaining the composite resin particle is surely performed, and the monomer or the oligomer is not leaved in the toner particle. Accordingly, any bad odor is not generated in the thermal fixing process of the image forming method of the invention.

Moreover, the image excellent in the sharpness can be formed for a prolonged period since the surface properties of each of the thus obtained toner particles are uniform and the charge distribution is sharp. By the toner in which the toner particles each have the uniform composition, molecular weight and surface property, the anti-offset ability and the anti-winding ability can be improved and the image having suitable glossiness can be obtained while maintaining the good adhesiveness (high fixing strength) in the image forming method including the fixing process by the contact heating system.

The parting agent to be employed in the toner according to the invention is described below.

The content of the parting agent constituting the electrostatic image developing toner according to the invention is usually from 1% to 30%, preferably from 2% to 20%, and more preferably from 3% to 15% by weight.

Low molecular weight polypropylene (number average molecular weight=1,500 to 9,000) or low molecular weight polyethylene may be added as the parting agent; ester compounds represented by the following formula are preferred. the composite particle is added to the solution of the surfactant, after that, the monomer composition containing the parting agent/crystalline polyester is dispersed in the aqueous solution and then the system is subjected to the polymerization treatment.

(b) On the occasion of the formation of the intermediate layer constituting the composite resin particle, the monomer composition containing the parting agent/crystalline polyester is dispersed in the aqueous solution of the surfactant, after that, the resin particle to be form the central portion (core) of the composite particle is added to the solution, and then the system is subjected to the polymerization treatment.

(c) On the occasion of the formation of the intermediate layer constituting the composite resin particle, the resin particle to be form the central portion (core) of the composite particle is added to the solution of the surfactant, at the same time, the monomer composition containing the parting agent/crystalline polyester is dispersed in the aqueous solution, and then the system is subjected to the polymerization treatment.

For forming the resin particle or covering layer each containing the parting agent, a method can be utilized in $$R_1—(OCO—R_2)_n$$

In the formula, n is an integer of from 1 to 4, preferably from 2 to 4, more preferably from 3 or 4, and particularly preferably 4.

$R_1$ and $R_2$ are each a hydrocarbon group which may have a substituent.

Number of the carbon atoms of $R_1$ is from 1 to 40, preferably from 1 to 20 and more preferable from 2 to 5.

Number of the carbon atoms of $R_2$ is from 1 to 40, preferably from 16 to 30, and more preferably from 18 to 26.

Concrete examples of the ester compound represented by the above formula are listed below.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3—(CH_2)_{20}—COO—(CH_2)_2—CH(CH_3)—CH_2—O—CO—(CH_2)_{20}—CH_3$

7) $CH_3—(CH_2)_{22}—COO—(CH_2)_2—CH(CH_3)—CH_2—O—CO—(CH_2)_{22}—CH_3$

-continued

8)

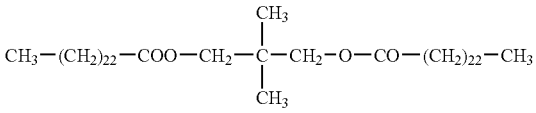

9)

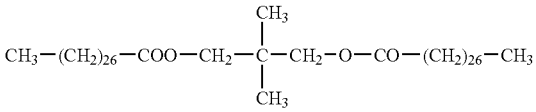

10)

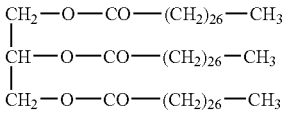

11)

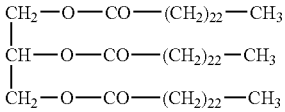

12)

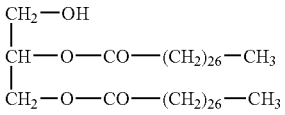

13)

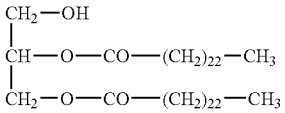

14)

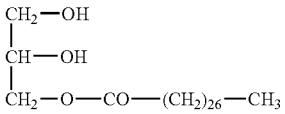

15)

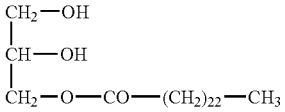

16)

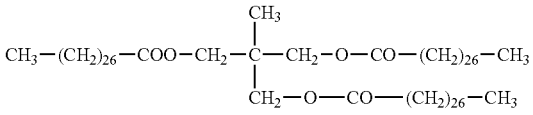

17)

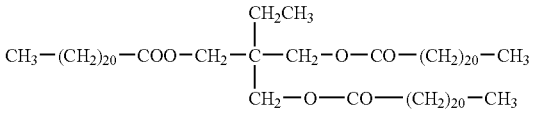

18)

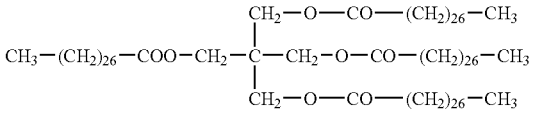

19)

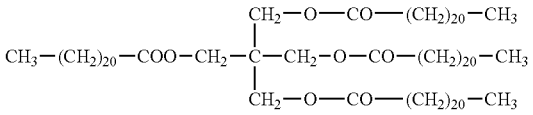

-continued

20)

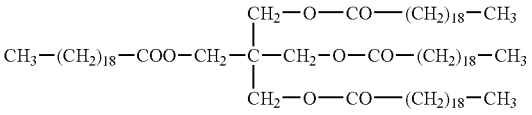

21)

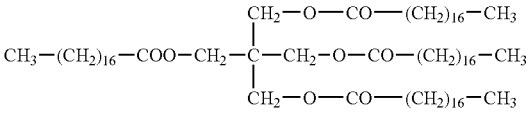

The adding amount of the compound represented by the above formula is from 1% to 30%, preferably from 2% to 20%, and further preferably from 3% to 15%, by weight of the total amount of the electrostatic image developing toner.

The preferable molecular weight and the peak molecular weight of the resin constituting the electrostatic image developing toner relating to the invention are described below.

The toner according to the invention preferably has a peak or shoulder within the range of from 100,000 to 1,000,000 and the range of from 1,000 to 50,000.

The resin of the toner is preferably one including a high molecular weight component having a peak or shoulder within the range of from 100,000 to 1,000,000 and a low molecular weight component having a peak or shoulder within the range of from 1,000 to less than 50,000.

The molecular weight is measured by gel permeation chromatography (GPC) using tetrahydrofuran (THF) for the column solvent.

In concrete, 1 ml of THF is added to 1 mg of the sample to be measured, and sufficiently dissolved the sample by stirring by a magnetic stirrer at a room temperature. After that, the solution is treated by a membrane filter having a pore size of from 0.45 to 0.50 μm and injected into the GPC. The measurement by the GPC is carried out under the condition of that the column is stabilized at 40° C., THF is flowed at a rate of 1 ml/minute and 100 μl of the sample solution having a concentration of 1 mg/ml is injected. A combination of polystyrene gel columns available on the market is preferably employed. For example, a combination of Shodex GPC KF-801, 802, 803, 804, 805, 806 and 607, manufactured by Showa Denko Co. Ltd., and a combination of TSK gel G1000H, G2000H, G3000H, G4000H, G5000H, G6000H, G7000H and TSK guard column are useful.

A refractive index detector (IR detector), or a UV detector is preferably employed as the detector. The molecular weight distribution of the sample is calculated according to a calibration curve prepared by using polystyrene standard particles. It is preferable to employ about ten kinds of the polystyrene particle for preparing the calibration curve.

The filtration•washing process is described below.

In the filtration•washing process, a filtering treatment for separating the toner particles from the toner particle dispersion by filtration and a washing treatment for removing adhering substances such as the surfactant and the coagulation agent from the filtered cake (a mass of the toner particles) are performed.

For filtration, a centrifugal method, a filtration under reduced pressure using a Buchner's funnel and a filtration by a filter press are applicable without any specific limitation.

<<Drying Process>>

This process is a process for drying the washed toner particles.

A spray dryer, a vacuum freezing drying machine and a reduce pressure drying machine are applicable, and a still rack dryer, a moving rack dryer, a fluid bed dryer, a rotary dryer and a stirring dryer are preferably utilized as the drying machine employed in the process.

The moisture content of the dried toner particles is preferably not more than 5%, and more preferably not more than 2%, by weight.

When the dried toner particles are become a solid mass by the weak attractive force between the particles, the mass may be subjected to a crushing treatment. The crushing may be performed by a crushing means such as a jet mill, a Henschel mixer, a coffee mill and a food processor are usable.

The polymerizable monomer relating to the invention is described below.

(1) Hydrophobic Monomer

Known monomers can be employed without any limitation for the hydrophobic monomer constituting the monomer composition. One or more kinds of the monomers can be employed in combination so as to satisfy the required properties.

In concrete, monovinyl aromatic type monomers, (meth) acrylate type monomers, vinyl ester type monomers, vinyl ether type monomers, monoolefin type monomers, diolefin type monomers and halogenated olefin monomers are employable.

Examples of the vinyl aromatic type monomer include styrene type monomers such as styrene, o-methylstyrene, m-methylstyrene, p-methylstyrene, p-methoxystyrene, p-phenylstyrene, p-chlorostyrene, p-ethylstyrene, p-n-hexylstyrene, p-n-octylstyrene, p-n-nonylstyrene, p-n-decylstyrene, p-n-dodecylstyrene, 2,4-dimethylstyrene and 3,4-dichlorostylene and their derivatives.

Examples of the acryl type monomer include acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate, diethylaminoethyl methacrylate.

Examples of the vinyl ester type monomer include vinyl acetate, vinyl propionate and vinyl benzoate.

Examples of the vinyl ether type monomer include vinyl methyl ether, vinyl ethyl ether, vinyl isobutyl ether and vinyl phenyl ether.

Examples of the monoolefin type monomer include ethylene, propylene, isobutylene, 1-butene, 1-pentene and 4-methyl-1-pentene.

Examples of the diolefin type monomer include butadiene, isoprene and chloroprene.

(2) Crosslinkable Monomer

A crosslinkable monomer may be added to improve the properties of the resin particle. Examples of the crosslinkable monomer are compounds each having two or more unsaturated bonds such as divinylbenzene, divinylnaphthalene, divinyl ether, diethylene glycol methacrylate, ethylene glycol dimethacrylate, polyethylene glycol dimethacrylate and diallyl phthalate.

(3) Monomer Having an Acidic Polar Group

Examples of the monomer having an acidic polar group include (a) α,β-ethylenic unsaturated compounds each having a carboxylic group (—COOH) and (b) α,β-ethylenic unsaturated compounds each having a sulfonic group (—$SO_3H$).

Examples of (a) α,β-ethylenic unsaturated compounds each having a carboxylic group (—COOH) are acrylic acid, methacrylic acid, fumalic acid, maleic acid, itaconic acid, cinnamic acid, monobutyl maleate, monooctyl maleate and their salt of metal such as Na and Zn.

Examples of (b) α,β-ethylenic unsaturated compounds each having a sulfonic group (—$SO_3H$) are sulfonated styrene and its Na salt, arylsulfosuccinic acid and octyl arylsulfoauccinate and its Na salt.

The initiator to be used for polymerization (referred also to as polymerization initiator) of the polymerizable monomer relating to the invention is described below.

As the polymerization initiator to be employed in the invention, water-soluble ones may be optionally employed. For example, persulfates such as potassium persulfate and ammonium persulfate; azo compounds such as 4,4'-azobis (4-cyanovalerianic acid) and its salts, 2,2'-azobis (2-diaminopropane) salts, and peroxide compounds such as hydrogen peroxide and benzoyl peroxide are usable.

The above polymerization initiator may be employed as a redox type initiator by combining with a reducing agent. By the use of the redox initiator, the polymerization activity is raised so as to lower the polymerization temperature, and shortening of the polymerization time can be expected.

Any temperature may be selected for polymerization as long as the temperature is not less than the lowest radical generation temperature, for example, a temperature from 50° C. to 80° C. is applied. Moreover, the polymerization at or near the room temperature can be performed by the use of a polymerization initiator capable of starting the polymerization at the room temperature such as a combination of hydrogen peroxide and a reducing agent such as ascorbic acid.

A chain-transfer agent to be used in the invention is described below.

In the invention, usually known chain-transfer agents can be employed for controlling the molecular weight of the resin particle formed by the polymerization of the polymerizable monomer.

Compounds each having a mercapto group are preferably used as the chain-transfer agent, by which the toner having a sharp molecular distribution, and displaying excellent storage ability, fixing strength and anti-offset ability can be obtained; for example, compounds having a mercapto group such as octanethiol, dodecanethiol and tert-dodecanethiol are employable.

Preferable compounds are, for example, ethyl thioglycolate, propyl thioglycolate, butyl thioglycolate, t-butyl thioglycolate, 2-ethylhexyl thioglycolate, octyl thioglycolate, octyl thioglycolate, decyl thioglycolate, dodecyl thioglycolate, ethylene glycol thioglycolate, neopentyl glycol thioglycolate and pentaerythritol thioglycolate.

Among them, an ester of n-octyl-3-mercaptopropionic acid is preferably employed from the viewpoint of inhibition of the odor on the occasion of the thermal fixing.

<<Colorant>>

The colorant relating to the invention is described below.

The colorants for the electrostatic image developing toners of yellow, magenta, cyan and black relating to the invention (hereinafter simply referred to as toner) are preferably each included in the toner particle by salt out, coagulation and fusion together with the foregoing composite resin particles in the course of the production of the toner from the viewpoint of the improvement in the uniformity of charging.

As the colorant (the colorant particle subjected to the salt out, coagulation and fusion together with the composite resin particle) constituting the toner relating to the invention, various kinds of inorganic pigment, organic pigment and dye are employable.

Black pigments for the black toner are, for example, carbon black such as furnace black, channel black, acetylene black, thermal black and lamp black and magnetic powder such as magnetite and ferrite.

These inorganic pigments can be optionally selected for use singly or in combination. The content of the inorganic pigment in the toner is preferably from 2% to 20%, and more preferably from 3% to 15%, by weight.

Magnetite may be added when the toner is used as the magnetic toner. In such the case, the content of the magnetite in the toner is preferably from 20% to 120% by weight for providing designated magnetic properties.

Known ones can be used as the organic pigment and dye. Concrete examples of the organic pigment and the dye are listed below.

Magenta or red organic pigments to be used for preparing the magenta toner are, for example, C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178 and C. I. Pigment Red 222.

Orange or yellow organic pigments to be used for preparing the yellow toner are, for example, C. I. Pigment Orange 31, C. I. Pigment Orange 43, C. I. Pigment Yellow 12, C. I. Pigment Yellow 13, C. I. Pigment Yellow 14, C. I. Pigment Yellow 15, C. I. Pigment Yellow 17, C. I. Pigment Yellow 93, C. I. Pigment Yellow 94, C. I. Pigment Yellow 138, C. I. Pigment Yellow 180, C. I. Pigment Yellow 185, C. I. Pigment Yellow 155 and C. I. Pigment Yellow 156.

Green or cyan pigments to be used for preparing the cyan toner are, for example, C. I. Pigment Blue 15, C. I. Pigment Blue 15:2, C. I. Pigment Blue 15:3, C. I. Pigment Blue 16, C. I. Pigment Blue 60 and C. I. Pigment Green 7.

Examples of the dye are C. I. Solvent Red 1, 49, 52, 58, 63, 111 and 122, C. I. Solvent yellow 19, 44, 77, 79, 81, 82, 93, 98, 103, 104, 112 and 162, and C. I. Solvent Blue 25, 36, 60, 70, 93 and 95. These dyes may be employed singly or as a mixture of a plurality thereof.

These pigments and dyes can be selected singly or as a combination of plural kinds according to the requirement. The content of the organic pigment or the dye in the toner is each preferably from 2% to 20%, more preferably from 3% to 15% by weight.

The colorant (colorant particle) relating to the invention is may be modified on the surface thereof. In concrete, silane coupling agents, titanium coupling agents and aluminum coupling agents are preferably employed for the surface modification.

Examples of the silane coupling agent include an alkoxysilane such as methyltrimethoxysilane, phenyltrimethoxysilane, methylphenyldimethoxysilane and diphenyldimethoxysilan; a siloxane such as hexamethyldisiloxane; γ-chloropropyltrimethoxysilane, vinyltrichlorosilane, vinyltrimethoxysilane, vinyltriethoxysilane, γ-methacryloxypropyltrimethoxysilane, γ-glycidoxypropyltrimethoxysilane, γ-mercaptopropyltrimethoxysilane, γ-aminopropyltriethoxysilane and γ-ureidopropyltriethoxysilane.

Examples of the titanium coupling agent are TTS, 9S, 83S, 41B, 46B, 55, 138S and 238S, manufactured by Ajinomoto Co., Ltd., which are available on the market under the commercial name of Plenact, and A-1, B-1, TOT, TST, TAA, TAT, TLA, TOG, TBSTA, A-10, TBT, B-2, B-4, B-7, B-10, TBSTA-400, TTS, TOA-30, TSDMA, TTAB and TTOP, manufactured by Nihon Soda Co., Ltd., each available on the market.

Example of the aluminum coupling agent is Plenact AL-M manufactured by Ajinomoto Co., Ltd.

The adding amount of the surface modification is preferably from 0.01 to 20%, and more preferably from 0.1% to 5%, by weight of the colorant.

For surface modifying the colorant particle, a method can be applied in which the surface modifying agent is added to the dispersion of the colorant particles and the resulted system is heated to react them.

The surface modified colorant particles are taken up by filtration and repeatedly subjected to washing and filtering treatment and then dried.

<<Internal Additive>>

The toner particle constituting the toner according to the invention may include an internal additive other than the parting agent such as a charge controlling agent.

The charge control agent is, for example, nigrosine type dyes, metal salts of naphthenic acid or higher fatty acids, alkoxylamine compounds, quaternary ammonium salts, azo metal complexes, metal salicylates and metal complexes thereof.

(Diameter of Toner)

The diameter of the toner is preferably from 3 μm to 10 μm, and more preferably from 3 μm to 8 μm in terms of number average diameter. The diameter of the toner can be controlled by the concentration of the coagulation agent, time of the fusion and the composition of the polymer in the later-mentioned production process.

When the number average diameter of the toner is within the range of from 0.3 μm to 10 μm, fine particle of the toner having high adhesiveness which is scattered and adhered to the heating member so as to cause offset, is reduced and the transfer efficiency is increased so that the quality of the halftone, fine line and dot image is improved.

Number average particle diameter of the toner can be measured by Coulter Counter TA-II, Coulter Multisizer, each manufactured by Coulter-Beckman Co., Ltd., and SD200 manufactured by Sysmex Co., Ltd.

Coulter Multisizer is connected to a personal computer through an interface for outputting the particle size distribution, manufactured by Nikkaki Co., Ltd. An aperture of 100 μm is used in Multisizer, and the number distribution of the toner particles having a particle diameter of not less than 2 μm (for example from 2 μm to 40 μm) is measured and the size distribution and the average particle diameter are calculated.

(Average Circular Degree of Toner Particle)

The shape of the toner particle in terms of the average of the circular degree (shape coefficient) represented by the following equation is from 0.94 to 0.99 when 2,000 or more particles having the diameter of not less than 1 μm are subjected to the measurement.

Circular degree=(Circumference length of the equivalent circle)/Circumference length of projection image of toner particle)=2π×(area of projection image of toner particle/π)$^{1/2}$/(Circumference length of projection image of toner)

Here, the equivalent circle is a circle having the same area as that of the projection area of the toner particle, and equivalent circle diameter is the diameter of the equivalent circle.

The circular degree can be measured by FPIA manufactured by Sysmex Co., Ltd. The equivalent circle diameter is defined by the following equation.

Equivalent circle diameter=2×(Projection area of particle/π)$^{1/2}$ (Shape coefficient of toner)

(Shape Coefficient of Toner Particle)

The shape coefficient of the toner particle is described below.

The shape coefficient of the toner is represented by the following equation, which represents the circular degree of the toner particle.

Shape coefficient=[(Largest diameter/2)$^2$×π]/projection area

In the above, the largest diameter is the largest distance of two parallel lines each circumscribing to the different sides of the image of the toner particle projected on a plane surface. The projection area is the area of the projection image of the toner particle on a plane surface.

In the invention, the shape coefficient is measured by analyzing a photograph of the toner particles taken by a scanning electron microscope with a magnitude of 2,000 times. The analysis of the photograph is carried out by Scanning Image Analyzer manufactured by Nihon Denshi Co., Ltd. The shape coefficient is calculated according to the above equation with respect to 100 particles.

In the toner particles constituting the electrostatic image developing toner, the content of the toner particle having a shape coefficient from 1.0 to 1.6 is preferably not less than 65%, and more preferably not less than 70%, in number. It is more preferable that the content of the toner particle having the shape coefficient of from 1.2 to 1.6 is not less than 65%, and more preferably not less than 70%, in number.

When the ratio of the toner particle having the shape coefficient of from 1.0 to 1.6, the triboelectric charging ability by the developer conveying member is made more uniform and accumulation of excessively charged toner is prevented and the problem such as ghost development is difficultly posed since the toner on the developer conveying member is easily exchanged. Moreover, secondary effects such as that the toner particles are difficultly crushed, the contamination of the developer conveying member is inhibited and the charging ability of the toner is stabilized are enhanced.

There is no limitation on the method for controlling the shape coefficient. For example, the toner having the shape coefficient of from 1.0 to 1.6 or that from 1.2 to 1.6 is prepared by a method in which the toner particles are sprayed into hot air stream, a method in which mechanical energy by impact force is repeatedly applying to the toner particles in a gas phase, or a method in which the toner particles are added into a solvent capable of not dissolving the toner particle and the resulted liquid is circled, and thus prepared toner is added to an ordinary toner so as to satisfy the requirements of the invention. Moreover, a method a method in which the shape of the toner particles are entirely controlled in the course of the formation of the toner particle by the polymerization method so that the shape coefficient is made to from 1.0 to 1.6 or from 1.2 to 1.6, and thus prepared toner is added to an ordinary toner as same as in the above.

(Variation Coefficient of Shape Coefficient of Toner Particles)

The variation coefficient of the shape coefficient is calculated by the following equation.

Variation coefficient(%)=$(S_1/K)$×100

In the equation, $S_1$ is the standard deviation of the shape coefficient of 100 toner particles, and K is the averaged value of the shape coefficient.

In the toner particles constituting the toner according to the invention, the variation coefficient of the shape coefficient is preferably not more than 16%, and more preferably not more than 14%. When the variation coefficient of the shape coefficient is not more than 16%, the distribution of charge is made further sharp and the image quality is further improved.

For controlling the shape coefficient and the variation coefficient of the shape coefficient and making them uniform with respect to the individual lot of the toner without scattering, the properties of the toner particles (colored particle) may be monitored during the formation thereof in the course of the process for preparing (polymerizing) the resin particles (polymerization) and that for fusing and controlling the shape of the resin particles to suitably decide the endpoint of such the processes. The "monitoring" means that the processing condition is controlled by the result measured by a measuring means built in the processing line. For example, in the case of the polymerization toner formed by associating or fusing the resin particles in the aqueous medium, the shape measuring means is built in the processing line, and the shape and diameter of the particles are measured in the process of the fusion while sampling in sequence and the reaction is stopped at the time when the desired shape can be obtained. As the method for monitoring, a flowing particle image analyzing apparatus FPIA-2000 (Toa Iyou Denshi Co., Ltd) can be employed, even though there is no limitation on the method.

This apparatus is suitable since the shape of the particle can be monitored by processing the image on real time while passing the sample liquid. The sample is taken up from the reaction place by a pump, and the shape is continuously monitored and the reaction is stopped at the time when the shape is attained at the desired state.

(Variation Coefficient of Particle Number of Toner)

The number distribution of particle size and the variation coefficient of number of the toner according to the invention are measured by Coulter Counter TA-II or Coulter Multisizer, each manufactured by Coulter-Beckman CO., Ltd.

In the invention, Coulter Multisizer is employed, which is connected to a personal computer through an interface (Nikkaki Co., Ltd.) outputting the particle size distribution. The Coulter Multisizer has an aperture having a size of 100 μm, and the volume and number of the toner particle having a diameter of not less than 2 μm were measured and the size distribution and the average diameter are calculate. The number distribution of particle size expresses the relative frequency of the toner particles with respect to the particle diameter, and the number average particle diameter is the median diameter on the number distribution of the particle size. The number variation coefficient in the number distribution of the particle size is calculated by the following equation.

$$\text{Number variation coefficient}=(S_2/Dn)\times 100$$

In the above equation, $S_2$ is the standard deviation in the number distribution of the particle size and Dn is the number average particle diameter (μm).

The number variation coefficient of the toner particles constituting the electrostatic image developing toner according to the invention is preferable not more than 27%, and more preferably not more than 25%.

The reason of the controlling the number variation coefficient to not more than 27% is to make the charging distribution to sharp, to raise the transfer efficiency so as to improve the image quality, the same as that in the case of the number variation coefficient of the shape coefficient of the toner particles.

Though the method controlling the number variation coefficient of the toner according to the invention is not specifically limited, for example, a method in which the toner particles are classified by wind, and a method of classifying in a liquid phase is effective to further reduce the number variation coefficient. As the method for classifying in the liquid phase, a method employing a centrifugal separator is applicable in which the toner particles are classified and recovered according to the difference of the precipitation rate caused by that of the particle diameter in a centrifugal separator by controlling the rotation number of the separator.

Particularly, when the toner is produced by a suspension polymerization method, the classifying is essential for making the number variation coefficient to not more than 27%. In the suspension polymerization, it is necessary to disperse the polymerizable monomer in the aqueous medium into oil drops each having the size desired for the toner particle. Namely, the large oil droplet should be made small by repeatedly applying mechanical sharing force until approximately the size of the toner particle. However, the particle size number distribution is resulted wide by such the mechanical sharing and, therefore, the size distribution of the obtained toner particle is also wide. Accordingly, the classification is essential.

(Particle Size Distribution of Toner Particle)

The toner particles constituting the toner according to the invention are preferable ones having the sum M of the relative frequency ml of the particles included in the highest frequency class and the relative frequency m2 included in the secondary high frequency class in the number based particle size histogram of not less than 70%. In the above histogram, the natural logarithm ln D, D is particle diameter of the tone in μm, is taken on the horizontal axis which is graduated into plural classes at intervals of 0.23. When the sum M of the relative frequency m1 and the relative frequency m2 is not less than 70%, the occurrence of selective development can be surely inhibited by the use of such the toner for the image formation process since the particle size distribution is made narrow.

In the invention, the histogram displays the number based particle size distribution in which the natural logarithm (D: the size of individual toner particle) is graduated into plural classes at an intervals of 0.23 (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76, . . . ). The histogram is prepared by that the particle diameter data measured by Coulter Multisizer according to the following conditions are transferred to a computer through an I/O unit and processed by the computer employing a particle size distribution analyzing program.

<<Measuring Condition>>

(1) Aperture: 100 μm (2) Sample preparation method: A suitable amount of a surfactant (neutral detergent) is added and stirred into from 50 to 100 ml of an electrolysis solution (Isoton R-11 manufactured by Coulter Scientific Japan Co., Ltd.), and from 10 mg to 20 mg of the sample is added to the above solution. The system is subjected to dispersing treatment for 1 minute by an ultrasonic dispersing apparatus.

(Particle Diameter Distribution of Toner Particle)

The particle diameter distribution of the toner according to the invention is described bellow.

The particle diameter distribution of the toner to be employed in the invention is preferably monodispersed or near monodispersed, and the ratio (Dv50/Dp50) of the 50%-volume particle diameter (Dv50) to the 50%-number particle diameter (Dp50) is preferably from 1.0 to 1.15, and more preferably from 1.0 to 1.15.

Moreover, it is preferable that the ratio (Dv75/Dp75) of the cumulative 75%-volume particle diameter from the larger side (Dv75) and the cumulative 75%-number particle diameter is from 1.0 to 1.20 for reducing the ratio of the ingredient having small particle diameter so that the increasing of the weakly charged constituent, and occurrence of the toner charged in the reversal polarity and the excessively charged constituent are prevented for improving the transferring ability and the cleaning ability and for obtaining an image excellent in the sharpness.

The ratio of the toner having a diameter of not more than 0.7D (Dp50) is not more than 10% in number is preferable for reducing the ratio of the small diameter ingredient and obtaining an image having high sharpness.

When a latent image formed on the photoreceptor is developed by the developer containing the toner having the foregoing particle size distribution, the developed image is transferred onto an intermediate transfer member and is transferred to a recording material from the intermediate transfer member and fixed, thus obtained image is improved in the image defects and the cleaning ability of the photoreceptor and the intermediate transfer member can be raised.

The 50%-volume particle diameter (Dv50) is preferably from 2 μm to 8 μm, and more preferably from 3 μm to 7 μm. By satisfying such the condition, the resolving power of the image can be further improved. Moreover, the amount of particles with excessively fine diameter can be reduced in the small diameter toner so that the cleaning property and the transferring ratio of the toner are improved for a long period and the formation of the images with high sharpness can be stably continued.

In the invention, the cumulative 75%-volume diameter (Dv75) and the cumulative 75%-number diameter (Dp75) from the larger side are each the volume diameter and the number diameter at the portion of the particle diameter distribution where the cumulus of the frequency from the larger side attains to 75% of the sum of the entire volume and the sum of the entire number, respectively.

In the invention, the 50%-volume particle diameter (Dv50), the 50%-number particle diameter (Dp50), the cumulative 75%-volume particle diameter (Dv75) and the cumulative volume 75%-number particle diameter (Dp75) can be measured by Coulter Counter TAII or Coulter Multisizer, each manufactured by Coulter-Beckman Co., Ltd, In the toner according to the invention, the ratio of the toner particle having the particle diameter of not more than 0.7×(Dp50) is 10% in number; the amount of such the fine particle can be measured by an electrophoretic light scattering photometer ELS-800 manufactured by Otsuka Electronics Co., Ltd.

<<Toner Particle without Corner>>

Regarding the shape of the particle of the toner according to the invention, a toner particle having no corner is preferably used.

The "particle without corner" is described below referring FIG. 1. The ratio of the toner particles without corner in the toner particles constituting the toner according to the invention is preferably not less than 50% in number and more preferably not less than 70% in number.

When the ratio of the toner particles without corner is not less than 50% in number, the space in the toner layer (particle layer) is reduced so that the fixing ability is improved and the occurrence of the offset is inhibited. Furthermore, the toner particles which are easily worn or crushed and the toner particles having the portion to which the charge is concentrated are reduced. Therefore, the charging distribution is made sharp and the charging is stabilized so that the good image can be formed for a long period.

The "toner particle without corner" is a toner particle having substantially no projection where the charge is concentrated and that easily worn by friction. In concrete the following particle is defined as the particle without corner. As is shown in FIG. 1, the particle without corner is a toner particle T in which a circle C having a radius of L/10, L is the major diameter of the particle, is substantially not jutted out from the out line of the particle when the circle C is rolled on inside of the outline of the particle while contacting at one point to the outline. The term of "substantially not jutted out" means that the number of the projection where the circle C is jutted out is one or less. The "major diameter" is the width of the particle at which the distance of two parallel lines each circumscribing to the different sides of the image of the toner particle projected on a plane surface is become largest. FIGS. 1*b* and 1*c* each show the projection image of the toner particle having the corner.

The measurement of the ratio of the toner particle without corner is measured as follows. The magnified photograph of the toner particles is taken by a scanning type electron microscope, and the photograph is further magnified to obtain a photographic image magnified by 15,000 times. The presence of the corner defined as above is measured on the image. The measurement is carried out with respect to 100 particles.

The method for obtaining the toner particle without corner is not specifically limited. Fore example, a method in which the toner particles are sprayed into hot air stream, a method in which mechanical energy by impact is repeatedly applied to the toner particles in a gas phase and a method in which the toner is added to a liquid which can not dissolve the toner and a circling stream is raised are applicable, these methods are described as the method for controlling the shape coefficient of the toner particles.

<<External Additive>>

The external additive to be employed in the charge image developing toner according to the invention is described below.

In the image forming method of the invention, the images formed on the photoreceptor are developed by the foregoing four color toners.

The toner according to the invention comprises the colored particle (original form of the toner particle) at least composed of the colorant and the resin and an additive externally added.

Generally, the colorant particle and the toner are described without exact distinction as long as a specific problem is not accompanied. In the particle diameter and the particle diameter distribution according to the invention, there is substantially no difference between the measurement results of the colored particles and those of the toner particles. Here, "there is substantially no difference" means that any difference is not observed between the particle diameter and the particle diameter distribution of the colored particles (the original form of the toner particle comprising the colorant and the resin) and those of the toner particle after the addition of the external additive even when the measurement is carried out by various known measuring apparatuses.

The diameter (number average primary particle diameter) of the external additive is at a place of nm, and can be measure by the light scattering electrophoretic particle diameter measuring apparatus ELS-800 manufactured by Otsuka Electronics Co., Ltd.

Among inorganic particles usable for the external additive, fine particle of silica, titania and alumina are preferably employed. These inorganic particles are preferably hydrophobic.

Concrete examples of the silica fine particle include R-805, R-976, R-974, R-972, R-821 and R-809 manufactured by Nihon Aerosil Co., Ltd., and HVK-2150, H-200 manufactured by Hoechst Co., Ltd., and TS-720, TS-530, TS-610, H-5 and MS-5 manufactured by Cabot Co., Ltd., which are available on the market.

Concrete examples of the titania fine particle include T-805 and T-604 manufactured by Nihon Aerosil Co., Ltd., MT-100, MT-100B, MT-500BS, MT-600, MT-600SS and JA-1 manufactured by Teika Co., Ltd., TA-300SI, TA-500, TAF-130, TAF-510 and TAF-510T manufactured by Fuji Titan Co., Ltd., and IS-S, IT-OA, IT-OB and IT-OC manufactured by Idemitsu Kosan Co., Ltd., which are available on the market.

Concrete examples of the alumina fine particle include RFY-C and C-604 manufactured by Nihon Aerosil Co., Ltd., and TTO-55 manufactured by Ishihara Sangyo Co., Ltd., which are available on the market.

Spherical organic fine particles having a number average primary particle diameter of approximately from 10 nm to 2,000 nm are usable as the external additive. As the material of such the organic fine particle, polystyrene, poly(methyl methacrylate) and styrene-methyl methacrylate copolymer can be utilized.

The same adding process as that for the addition of the slipping agent can be applied to the addition of the external additive. Known mixing apparatuses such as a tubular mixer, a Henschel mixer, a tauner mixer and a V-type mixer can be applied.

<<Developer>>

The toner according to the invention may be employed as a single-component developer and a double-component developer.

In the case of the single-component developer, both of a non-magnetic single-component developer and a magnetic single-component developer in which the toner particle contains magnetic particles having a diameter of from about 0.1 μm to 0.5 μm are employable.

Moreover, the toner particle may be used as the double-component developer by mixing with a carrier. In such the case, known materials such as iron, ferrite and magnetite and their alloys with another metal such as aluminum and lead are employable as the magnetic particle of the carrier. The ferrite particle is particularly preferred. The magnetic particles preferably have a volume average particle diameter of from 15 μm to 100 μm and more preferably from 25 μm to 80 μm.

The volume average particle diameter can be typically measured by a laser diffraction particle distribution measuring apparatus Helos manufactured by Sympatec Co., Ltd.

The carrier is preferably a carrier in which the magnetic particle is further coated with resin or a resin dispersed carrier in which the magnetic particle is dispersed in resin. Tough the composition of the resin for the coating is not specifically limited, for example, olefin type resins, styrene type resin, styrene-acryl type resins, silicone type resins and fluorinated type resins are employed. For the resin constituting resin dispersed carrier, known ones can be employed without any limitation, for example, styrene-acryl type resins, polyester type resins, fluorinated type resins and phenol resins can be employed.

<<Photoreceptor>>

The photoreceptor is described below.

The photoreceptor to be employed in the invention is an electrophotographic photoreceptor for electrophotographic image formation. Among them, the effects of the invention are enhanced when the invention is applied to an organic electrophotographic receptor (organic photoreceptor). The organic photoreceptor is an electrophotographic photoreceptor in which at least one of the charge generation function and the charge transfer function is allocated to an organic compound, such the functions are essential to the constitution of the electrophotographic photoreceptor. The organic photoreceptor includes ones constituted by a known organic charge generation substance or an organic charge transfer material and ones constituted by a polymer complex having the charge generation function and the charge transfer function.

The organic photoreceptor to be employed in the invention is described below.

<<Electroconductive Support>>

The sheet shaped and cylindrical support may be employed as the electroconductive support of the photoreceptor, and the cylindrical electroconductive support is preferable for designing a compact image forming apparatus.

The cylindrical electroconductive support is a cylindrical support necessary for endlessly forming images by the rotation thereof, and an electroconductive support having a straightness of not more than 0.1 mm and a swinging of not more than 0.1 mm is preferred.

As the electroconductive material, a metal drum of aluminum or nickel, a plastic drum on which aluminum, tin oxide or indium oxide is deposited, and a paper or plastic drum coated with an electroconductive substance are employable, the specific resistance of the electroconductive support is preferably not more than $10^3$ Ωcm.

<<Intermediate Layer>>

An intermediate layer having a function of improving the adhesion with the photosensitive layer and that of electric barrier may be provided between the electroconductive support and the photosensitive layer.

As the material of the intermediate layer, polyamide resin, vinyl chloride resin, vinyl acetate resin and a copolymer resin containing two or more repeating units of theses resins are employable.

An intermediate layer may be employed which is constituted by a hardenable metal resin formed by hardening an organic metal compound such as a silane coupling agent and a titanium coupling agent. The thickness of the intermediate layer using the hardenable metal resin is preferable from 0.1 μm to 5 μm.

<<Photosensitive Layer>>

Though the layer constitution of the photosensitive layer of the photoreceptor may be a single-layer structure in which the charge generation function and the charge transfer function are allocated to one layer, a constitution is preferable, in which the function of the photoreceptor is separated to a charge generation layer (CGL) and a charge transfer function layer (CTL). When the functions are separated, increasing of the remaining potential accompanied with the repeating use can be controlled so as to be small and the other electrophotographic properties can be easily controlled so as to be suited for the purposes. In the photoreceptor for negative charge, it is preferable that the charge generation layer (CGL) is provided on the intermediate layer and the charge transfer layer (CTL) is provided on the charge generation layer. In the photoreceptor for positive charge, the order of the constituting layers is reversed in the case of the photoreceptor for negative charge. The most preferable constitution of the photoreceptor is the negatively charged photoreceptor having the function separated structure.

The constitution of the negatively charged function separated photoreceptor is described below.

<<Charge Generation Layer>>

The charge generation layer contains a charge generation material (CGM). Another material such as a binder may be contained according to necessity.

Known charge generation materials (CGM) can be employed as the charge generation material. For example, phthalocyanine pigments, azo pigments, perylene pigments and azulenium pigments are usable. Among them, the CGM capable of reducing the increasing of the remaining potential accompanied with the repeating use so as to be the minimum is one having a steric and potential structure so that a stable aggregated structure can be taken between plural molecules. In concrete, the phthalocyanine pigments and the perylene pigments each having a specific crystal structure are employed as the CGM.

For example, the CGM such as titanylphthalocyanine having the maximum peak of Bragg angle 2θ of Cu—Kα lay at 27.2° and benzimidazoleperylene having the maximum peak of Bragg angle 2θ of Cu—Kα lay at 12.4° are almost not degraded accompanied with the repeating use and the remaining potential can be reduced by the use thereof.

When a binder is used as the dispersing medium of CGM in the charge generation layer, known resins may be employed as the binder, and formal resins, butyral resins, silicone resins, silicone-modified butyral resins and phenoxy resins are most preferable. The ratio of the charge generation material to the binder is from 20 to 600 parts per 100 parts by weight of the binder. The increasing of the remaining potential accompanied with repeating use can be minimized by the use of such the resins. The thickness of the charge generation layer is preferably from 0.01 μm to 2 μm.

<<Charge Transfer Layer>>

The charge transfer layer contains the charge transfer material (CTM) and a binder resin for dispersing the CTM and forming the layer. Another material such as an antioxidation agent may be contained according to necessity.

As the charge transfer material (CTM), known charge transfer materials (CTM) can be employed. For example, triphenylamine derivatives, hydrazone compounds, styryl compounds, benzidine compounds and butadiene compounds are usable. These charge transfer materials are usually dissolved in the suitable binder resin and formed into a layer. Among them, the CTM capable of minimizing the increasing of the remaining potential accompanied with repeating use is one having high charge mobility and the difference of the ionization potential between the CGM to be combined of from not more than 0.5 eV, and preferably not more than 0.25 eV.

The ionization potential of the CGM and CTM are measured by a surface analyzing apparatus AC-1 manufactured by Riken Keiki Co., Ltd.

Examples of the resin to be employed in the charge transfer layer (CTL) include polystyrene resins, acryl resins, methacryl resins, vinyl chloride resins, vinyl acetate resins, poly(vinyl butyral) resins, epoxy resins, polyurethane resins, phenol resins, polyester resins, alkyd resins, polycarbonate resins, silicone resins, melamine resins and copolymers containing two or more of the repeating units of these resins. Other than the above insulation resins, organic semi-conductive polymers such as poly-N-vinylcarbazole are employable. The most preferable resin for the binder of CTL is polycarbonate resin. The thickness of the charge transfer layer is preferably from 10 to 40 μm.

The thickness of the charge transfer layer is preferably controlled to from 5 μm to 15 μm in average to reduce the difference of the permittivity on the photoreceptor so as to stabilize the developing ability and the transfer ability of the toner and to preferably obtain the effects of the invention. The thickness is more preferably from 6 μm to 13 μm. The thickness of the charge transfer layer can be measured by a layer thickness measuring apparatus utilizing eddy current Eddy 560C manufactured by Helmut Fischer GMBTE Co., Ltd. For measuring the thickness of the charge transfer layer, the thickness of photoreceptor is measured at randomly elected 10 points and the thickness of the charge transfer layer is defined from the average of the measured value. The fluctuation of the photosensitive layer is preferably not more than 2 μm in the difference between the largest thickness and the smallest thickness of the layer.

<<Protective Layer>>

A layer of various kinds of resin may be provided as the protective layer of the photoreceptor. Particularly, the organic photoreceptor having high mechanical strength can be obtained by the use of a crosslinked resin layer.

<<Image Forming Method>>

The image forming method according to the invention is described below.

The image formation according to the invention using four color toners of yellow, magenta, cyan and black is preferably performed by an image forming apparatus having a means for forming the electrostatic latent image on the photoreceptor having a photosensitive layer on the electroconductive support, a means for developing the electrostatic image by the developers each containing the four color toners to form a toner image, a means for transferring the toner image onto a image receiving material (paper) and a means for fixing the color toners by a heating roller onto the image receiving material.

FIG. 2 shows a cross section of a color image forming apparatus as an embodiment of the image forming method for forming a full color image employing the four color toners of yellow, magenta, cyan and black.

In FIG. 2, 100 is a photoreceptor drum (photoreceptor) as the image forming member in which the organic photosensitive layer is coated on the drum (electroconductive support) and a resin layer is coated thereon; the photoreceptor drum is grounded and driven so as to be clockwise rotated. Numeral 120 is a scorotron charging device by which the circumference surface of the photoreceptor drum 100 is uniformly charged. The surface of the photoreceptor may be discharged by exposing light an exposing device 110 using a light emission diode in advance to the charging by the scorontron charging device 120 for erasing the hysteresis of the photoreceptor by the last image formation.

After the uniformly charging of the photoreceptor, imagewise exposing is performed according to image signals by an image exposing device 130. The imagewise exposing device 130 has a laser diode as the light source, which is not displayed in the drawing. The photoreceptor drum surface is scanned to form a electrostatic latent image by a light beam passed through a rotating polygon mirror 131, an fθ lens and turned by a reflection mirror 132.

The electrostatic latent image is developed by a developing device 140. The developing devices 140 each containing the yellow, magenta, cyan and black toner and the carrier are arranged around the photoreceptor drum 100, and the development of the first color is carried out a developing sleeve 141 including a magnet, which is rotated while holding the developer. The developer is formed into a layer having a thickness of from 100 μm to 600 μm on the developing sleeve 141 by a layer thickness regulation means, not displayed in the drawing, and conveyed into the developing zone so as to perform the development. On the occasion of the development, bias voltage of direct current and/or alternative current is usually applied between the photoreceptor drum 100 and the developing sleeve 141.

In this instance development is usually carried out by applying direct and/or alternative current between the photoreceptor 100 and developing sleeve 141.

For forming the full color image, the second color image formation process is started after the development of the first color image, and the photoreceptor is uniformly charged for the second time by the scorotron charging device 120, and then the latent image of the second color is formed by the imagewise exposing device 130. The third and fourth color images are each formed by the image forming process the same as that in the second color image formation so that the four color images are formed on the surface of the photoreceptor drum 100.

After the image formation, the image receiving material (paper) P is conveyed to the transfer zone by the rotation of a supplying roller 170 when the timing for the transfer is adjusted. In the transfer zone, the transfer roller (transfer device) is contacted to the surface of circumference surface of the photoreceptor 100 synchronizing with the timing for the transfer so that the plural color images are collectively transferred.

After that, the image receiving material (paper) P is discharged by a separation brush (separation device) which is contacted to the photoreceptor surface at almost the same time as the contacting of the transfer roller, and is separated from the surface of the photoreceptor 100 and conveyed to a fixing device 200. The color toners are fused onto the color receiving material by heating and pressing by a heating roller 201 and a pressing roller 202, and the image receiving material is released from the apparatus through an outputting roller 210.

The transfer roller 18 and the separating brush 19 are departed from the surface of the photoreceptor drum 100 after passing of the image receiving material (paper) P so as to prepare for the next image formation.

After the separation of the image receiving (paper) P, the photoreceptor drum 100 is subjected to cleaning by contacting the blade 221 of the cleaning device 220 for removing and cleaning the toner remaining on thereon, and then discharged by the exposing device 110 and charged by the charging device. After that, the photoreceptor drum is introduced into the next image forming process. On the occasion of the formation of the overlaid color images, the blade 221 is moved to depart from the surface of the photoreceptor 100 just after the completion of the cleaning.

Numeral 30 denotes a detachable process cartridge which is integrated with a photoreceptor, a charger, a transfer device, separation device and a cleaning device.

In the electrophotographic image forming apparatus, the constitution elements such as the photoreceptor, developing device and cleaning device may be united into a processing cartridge which can be optionally installed to or released from the main body of the apparatus. Moreover, at least one of the charging device, imagewise exposing device, developing device, transfer device and cleaning device may be united with the photoreceptor to form a processing cartridge capable of optionally installing to or releasing from the main body of the apparatus employing a rail.

In the invention, an image forming apparatus can be employed other than that displayed in FIG. 2, which the toner images formed on the photoreceptor are each successively transferred onto the receiving member (paper of an intermediate transfer member) so as to overlay the images to form the color toner image. An embodiment of such the image forming apparatus is described referring FIG. 3.

Figure 3:
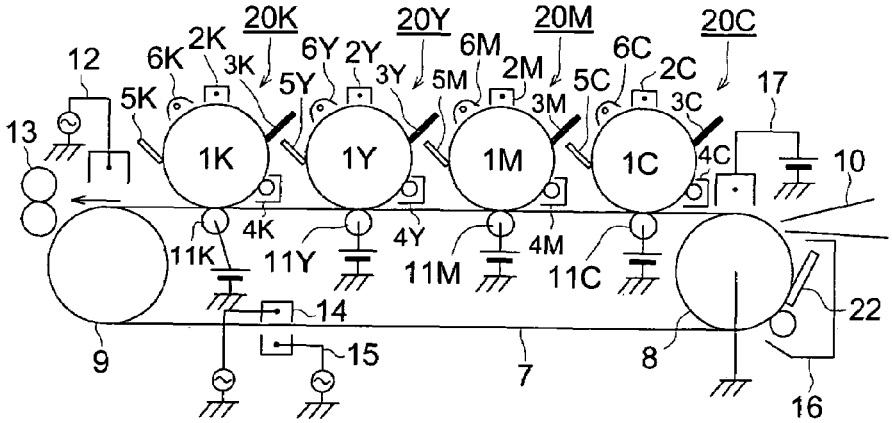
FIG. 3 shows a cross section of an example of image forming apparatus employing an intermediate transfer member (transfer belt).

FIG. 3 shows a cross section of an example of the image forming apparatus according to the invention in which an intermediate transfer member is employed. The image forming apparatus shown in FIG. 3 is called as a tandem type full color image forming apparatus.

At the central portion of the interior of the image forming apparatus shown in FIG. 3, a driving roller 9 rotated by a motor, not displayed in the drawing, and a roller 9 rotated following to the driving roller are installed in parallel so that the rotating axes are set each in the horizontal direction, the rollers have almost the same size. The roller 9 is grounded. An endless transfer belt 7 is put without slackening. The transfer belt 7 is a film type belt made from PVDF (vinylidene polyfluoride) or PC (polycarbonate) or a rubber type belt made from chloroprene rubber or urethane rubber. The transfer belt has a width almost the same as that of the driving roller 9, and is driven in the direction of the arrow sign in the drawing (conveying direction of recording material) by the friction at the interior surface of the belt with the rollers.

Along the going way of the transfer belt 7, photoreceptor drums 1C through 1K each carrying a cyan (C), magenta (M), yellow (Y) and black color images are nearly arranged in the order from the side of the following roller 8 so that the rotating axes are parallel with a driving roller 9. These drums are each driven following and synchronizing with the driving of the transfer belt. Around the transfer belt, a cleaning device 16 is provided at the circumference surface of the belt facing the following roller 8, and a paper supplying guide 10 and an attracting charger 17 are provided at the lower course of the stream of the cleaning device along the direction of the arrow sign. A separation charger 12 is provided at the lowest course of the stream after the photoreceptor drums 1C through 1K, and a charge removing charger 14 and 15 are successively provided on the turning way of the transfer belt 7.

In the image forming zones 20C through 20K, the photoreceptor drums 1C through 1K and charging devices 2C through 2K, imagewise exposing devices 3C through 3K, developing devices 4C through 4K, transfer devices 11C through 11K, cleaner 5C through 5K and erasers 6C through 6K are each arranged in this order along the rotating direction of the photoreceptor drum.

The transfer rollers 11C through 11Y and 11K are transfer rollers rotating on the inner surface of the transfer belt.

At the upper portion of the image forming apparatus, an image leading means including a CCD scanner for leading out the original image, an exposing lump, a controlling unit and an image memory, and an optical system including a polygon mirror and a plurality of lens by which the lead image is converted to designated image data and introduced into the image forming means 20C through 20K.

The action of the apparatus is described below. R (red), G (green) and B (blue) components of the image data of the original image are converted to the image data of C, M, Y and K by the data conversion treatment in the controlling unit. The image data are once stored in the image memory by the controlling unit.

Synchronizing with the leading out of the original image, the image receiving material (also called as the image support or recording paper and may be one capable of receiving the image) is conveyed along the paper supplying guide 10 onto the outer surface of the transfer belt 7 just under the absorption charger. The image receiving material is attracted by the positive electrostatic electro force onto the transfer belt 7 when the absorption charger 17 discharges, and conveyed each of the image forming zones 20C through 20K. The image data temporarily stored in the memory are read out synchronously with the conveying of the image receiving material by the transfer belt 7 and modulate the laser light by the controlling unit. The laser light irradiates the surface of the photoreceptor drums through the optical system. And then the developing devices 4C through 4K each form color images on the photoreceptor surface. Thus formed each color component images are successively transferred from the surface of the photoreceptor drums 1C through 1K onto the designated position of the recording paper by electric fields each generated by the transfer rollers 11C through 11K.

After the transfer, the recording paper is discharged and separated from the transfer belt 7 by an alternative electric field generated by separation charger, and the image is fixed in the fixing device 13. After that, the recording paper is output from the apparatus.

After separation of the recording paper, the transfer belt 7 is discharged by charge removing chargers 14 and 15 each connected to an alternative current power source and the surface thereof is cleaned by removing the toner adhering on the surface by a cleaning device 16. In the above-mentioned, the description is based on the example of the apparatus employing the photoreceptor drum. Though the photoreceptor is a typical example of the electrostatic latent image carrying member, the image carrying member is not limited to the photoreceptor in the invention. Though the shape of the photoreceptor is not limited to the drum, it may be a belt. Though the transfer belt 7 is described with respect to a soft belt, for example, it may be one having a drum shape.

Figure 4:
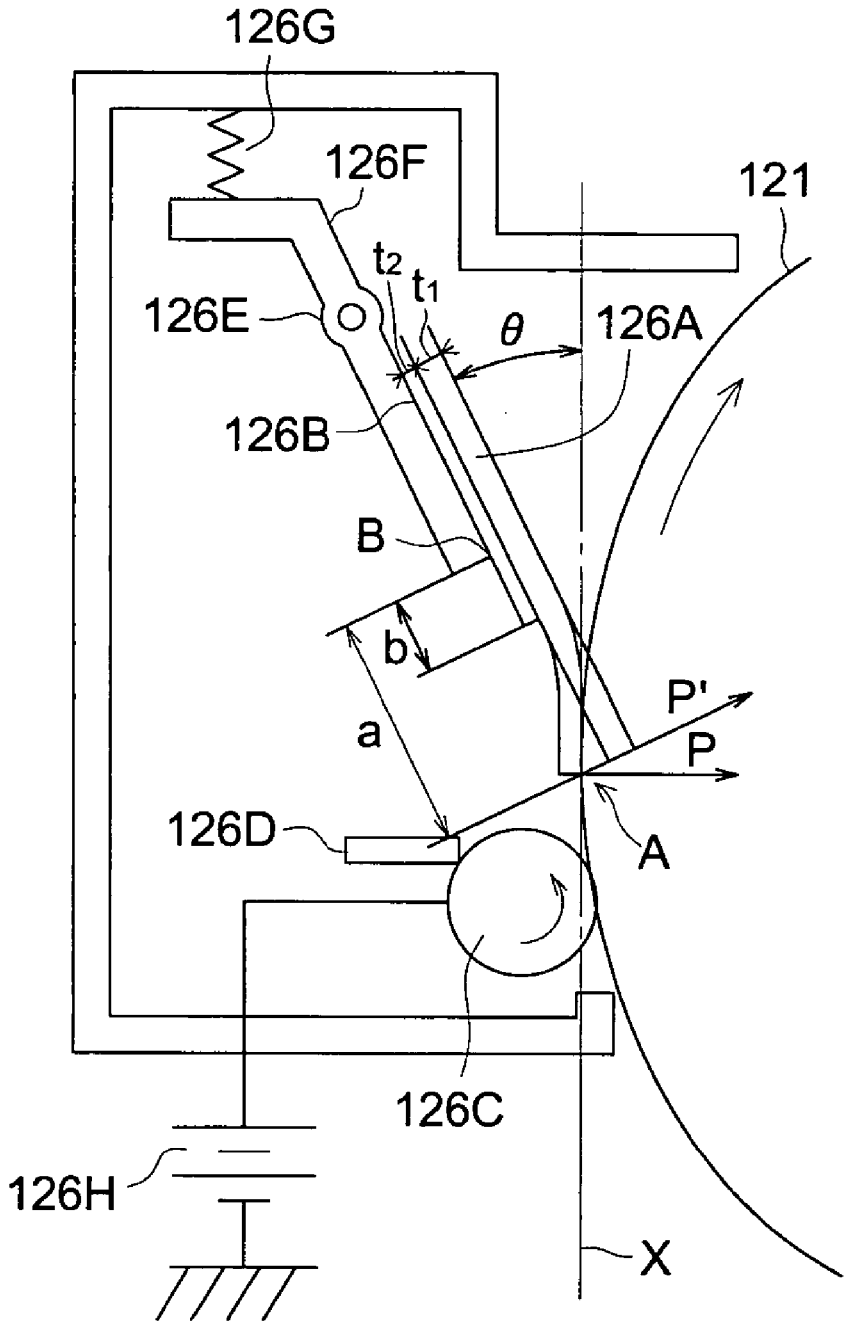
FIG. 4 shows the constitution of an example of cleaning device for a photoreceptor.

FIG. 4 shows an example of the cleaning device of the photoreceptor.

The cleaning device 126 has a cleaning blade 126A and a cleaning roller 126C. The cleaning blade 126A is held by a fixed supporting member (blade holder), and the top edged of the blade is contacted to the photoreceptor 121 with an almost constant pressure by the elasticity of the blade. As is shown in FIG. 4, the top end of the cleaning blade preferably forms a contacting face when contacting with the photoreceptor.

The supporting member 126F is able to rotate around the axis, and the supporting member giving a constant pressure to the cleaning blade 126A by a spring or gravity can be also utilized. The top end of the cleaning blade 126A is contacted to the photoreceptor 121 so that the contacting angle θ is made to an acute angle, namely the blade is contacted to the photoreceptor in the counter direction to the rotation direction of the photoreceptor.

Preferable values of the contacting load P and the angle θ are P=5 to 40 N/m and θ=5 to 35°.

The loading P is a vector value in the normal line direction of the contacting force P' when the cleaning blade 126A is contacted to the photoreceptor drum 121.

The contacting angle θ is an angle formed by the normal line X and the blade before deformation represented by the broken line in the drawing. 126E is the rotation axis of the supporting member and 126G is a loading spring.

The cleaning roller 126C, to which bias voltage is applied from a constant current power source 126H, attracts the toner on the photoreceptor 121 by electrostatic force. The polarity of the bias voltage is reverse to that of the toner and contributes to the development in the developing means (developing device 123). As is shown in FIG. 4, a scraper 126D as the removing means is contacted in the counter direction so as to remove the toner recovered from the photoreceptor 121 and adhered to the cleaning roller 126C.

EXAMPLES

The invention is described below referring examples.

Example 1

<<Preparation of Latex>>

(Preparation of Latex 1HML)

(1) Preparation of Latex 1H (Formation of Core Particle: the First Step of Polymerization)

Into a 5,000 ml separable flask, to which a stirring device, a thermal sensor, a cooling pipe and a nitrogen gas introducing device are attached, a surfactant solution (aqueous medium) composed of 3040 g of deionized water and 4 g of an anionic surfactant represented by the following formula 101 dissolved in the deionized water was charged and heated by 80° C. while stirring at a stirring rate of 230 rpm.

$$C_{10}H_{21}(OCH_2CH_2)_2OSO_3Na \qquad \text{Formula 101}$$

To the surfactant solution, an initiator solution composed of 400 g of deionized water and 10 g of a polymerization initiator (potassium persulfate:KPS) dissolved therein was added and then the temperature was adjusted to 70° C. After that, a mixture of monomers composed of 528 g of styrene, 204 g of n-butyl acrylate, 68 g of methacrylate and 24.4 g of n-octyl-3-mercaptopropionic acid ester was dropped spending 1 hour. The system was heated and stirred at 75° C. for 2 hours to perform the polymerization (the first step polymerization) to form latex. The latex was referred to as Latex 1H.

(2) Preparation of Latex 1HM (Formation of Intermediate Layer: the Second Step of Polymerization)

A monomer solution was prepared by dissolving 77 g of a crystalline compound represented by the foregoing Formula 19, hereinafter referred to as Exemplified Compound 19, into a monomer mixture liquid composed of 95 g of styrene, 36 g of n-butyl acrylate, 9 g of methacrylic acid and 0.59 g of n-octyl-3-mercaptopropionic acid ester at 90° C. in a flask to which a stirring device was attached.

On the other hand, a surfactant solution composed of 1,560 ml of deionized water and, dissolved therein, 1 g of the anionic surfactant represented by Formula 101 was heated by 98° C. and 28 g in terms of solid ingredient of Latex 1H which is a dispersion of the core particles was added to the surfactant solution. Then the above prepared monomer solution of Exemplified Compound 19 was mixed and dispersed for 8 hours in the above resulted liquid by a mechanical dispersing apparatus having a circulation pass Clearmix manufactured by M•Technique Co., Ltd., to prepare a dispersion (emulsion) containing emulsified particles (oil droplets) having a particle diameter of 84 nm.

After that, an initiator liquid composed of 200 ml of deionized water and 5 g of the polymerization initiator (KPS) dissolved therein, and the system was heated and stirred for 12 hours at 98° C. to perform polymerization (second step polymerization). Thus latex was obtained which was referred to as Latex 1HM.

(3) Preparation of Latex 1HML (Formation of Outer Layer: the Third Step of Polymerization)

To thus obtained Latex HML, an initiator solution composed of 265 ml of deionized water and 6.8 g of the polymerization initiator (KPS) dissolved therein was added and then a monomer mixture liquid composed of 249 g of styrene, 88.2 g of n-butyl acrylate, 2 g of methacrylic acid and 7.45 g of n-octyl-3-mercaptopropionic acid ester was dropped to the latex spending for 1 hour. After completion of the dropping, the resulted liquid was heated and stirred for 2 hours for polymerization (third step polymerization), and then cooled by 28° C. to obtain latex. Thus obtained latex was referred to as Latex 1HML.

The weight average particle diameter of the composite resin particles constituting Latex 1HML was 122 nm.

(Preparation of Latex 2L (Shell Material))

Into a flask with a stirring device, an initiator solution composed of 400 ml of deionized water and 14.8 g or the polymerization initiator (KPS) dissolved therein was charged, and a monomer mixture liquid composed of 600 g of styrene, 190 g of n-butyl acrylate, 10.0 g of methacrylic acid and 20.8 g of n-octyl-3-mercaptopropionic acid ester was dropped spending 1 hour at 80° C. After completion of the dropping, the liquid was heated and stirring for 2 hours for progressing the polymerization and then cooled by 27° C. to obtain latex (dispersion of resin particles composed of low molecular weight resin). The latex was referred to as Latex 2L.

The resin particles have a peak molecular weight of 11,000 and a weight average particle diameter of 128 nm.

<<Preparation Example of Colored Particle>>

Four colored particles of Colored particle Bk1 (black), Y1 (yellow), M1 (magenta) and C1 (cyan) were prepared as follows.

<<Preparation of Colorant Particle Bk1>>:Black (1) Preparation of Dispersion 1 of Colorant In 1,600 ml of deionized water, 90 g of the anionic surfactant was dissolved by stirring. To the solution, 400.0 g of carbon black Regal 330R manufactured by Cabot Co., Ltd., was gradually added while stirring, and then dispersed by the stirring apparatus Cleamix manufactured by M•Technique Co., Ltd. to prepare a dispersion of the colorant particles. The dispersion was referred to as Colorant Dispersion 1.

The particle diameter of the colorant particle in Colorant Dispersion 1 measured by the electrophoretic light scattering photometer ELS-800, manufactured by Otsuka Electronics Co., Ltd., was 110 nm.

(2) (Coagulation•Fusion) Preparation of Associated Particle

Into a reaction vessel (four-mouth flask) to which a thermal sensor, a cooling tube, a nitrogen gas introducing device and a stirring device were attached, 420.7 g in terms of solid ingredient of Latex 1HML, 900 g of deionized water and 200 g of Colorant Dispersion 1 were charged. The inner temperature of the vessel was adjusted to 30° C. and then the pH value of the liquid was adjusted to 8 by adding an aqueous solution of sodium hydroxide.

After that, a solution composed of 1,000 ml of deionized water and, dissolved therein, 2 g of magnesium chloride hexahydrate was dropped to the above liquid spending for 10 minutes at 30° C. The liquid was stood for 3 minutes and then heated by 90° C. spending 60 minutes. Under such the conditions, the diameter of the associated particle was measured by Coulter Counter TA-II, and an aqueous solution composed of 1,000 ml of deionized water and, dissolved therein, 40.2 g of sodium chloride was added a time when the number average diameter of the particles was attained at 4 μm to stop the growing the particles. Moreover, the fusion of the particles was continued as a ripening treatment by heating and stirring for 6 hours at 98° C.

(3) Shell Forming Treatment

Furthermore, 96 g of Latex 2L (dispersion of resin particles) was added to the resulted liquid and the system was heated and stirred for 3 hours to fuse latex 2L onto the surface of the associated particle of Latex 1HML. Thereafter, the liquid was added with 40.2 g of sodium chloride and cooled by 30° C. in a rate of 8° C./minute and then the pH was adjusted to 2.0 by the addition of hydrochloric acid, and the stirring was stopped. Thus obtained particles were filtered and repeatedly washed by deionized water at 40° C. and dried by warmed air at 40° C. Thus Colored Particle Bk1 having the average circular degree described in Table 1.

Bk2 through Bk8 were prepared each having the average circular degree described in Table 1 by controlling the dispersing state of the colorant particles by means of control of the pH value, the timing of the addition of Latex 2 and the strength of stirring, and further by controlling the particle diameter and the variation coefficient of the distribution thereof by the classification in liquid.

<<Preparation of Colored Particles M1 through M8>>: Magenta

Colored Particles of M1 through M8 were each prepared in the same manner as in Colored Particles Bk1 through Bk8 except that C. I. Pigment Red 122 was employed in place of carbon black Regal 330R manufactured by Cabot Co., Ltd., and the average particle diameter and the distribution thereof were controlled so as to be those described in Table 1.

<<Preparation of Colored Particles C1 through C8>>:Cyan

Colored Particles of C1 through C8 were each prepared in the same manner as in Colored Particles Bk1 through Bk8 except that C. I. Pigment Blue 15:3 was employed in place of carbon black Regal 330R manufactured by Cabot Co., Ltd., and the average particle diameter and the distribution thereof were controlled so as to be those described in Table 1.

TABLE 1

| Color of colored particle | Colored particle No. | Average circular degree |
|---|---|---|
| Magenta | M1 | 0.966 |
| | M2 | 0.963 |
| | M3 | 0.969 |
| | M4 | 0.958 |
| | M5 | 0.971 |
| | M6 | 0.980 |
| | M7 | 0.951 |
| | M8 | 0.961 |
| Cyan | C1 | 0.967 |
| | C2 | 0.963 |
| | C3 | 0.968 |
| | C4 | 0.959 |
| | C5 | 0.972 |
| | C6 | 0.980 |
| | C7 | 0.951 |
| | C8 | 0.963 |
| Yellow | Y1 | 0.965 |
| | Y2 | 0.961 |
| | Y3 | 0.968 |
| | Y4 | 0.955 |
| | Y5 | 0.973 |
| | Y6 | 0.982 |
| | Y7 | 0.950 |
| | Y8 | 0.960 |
| Black | Bk1 | 0.965 |
| | Bk2 | 0.964 |
| | Bk3 | 0.968 |
| | Bk4 | 0.957 |
| | Bk5 | 0.970 |
| | Bk6 | 0.979 |
| | Bk7 | 0.950 |
| | Bk8 | 0.962 |

Example 1-1

<<Preparation of Toner>>

(Preparation of Black Toner Particle Bk1): with Addition of Large Diameter External Additive To Colored Particle Bk1, 1% by weight of hydrophobic silica having a number average primary particle diameter of 12 nm and a hydrophobic degree of 68 were added and 0.21% by weight of the later-mentioned inorganic/organic Composite Particle 1 was further added and mixed by a Henschel mixer to prepare Black Toner Particle Bk1.

(Preparation of Black Toner Particles Bk2 through Bk7): with Addition of the Large Diameter Particle External Additive Black Toner particles Bk2 through Bk8 were prepared in the same manner as in Black Toner Particle Bk1 except that the large particle diameter external additives described in Table 2 were employed in place of inorganic/organic Composite Particle 1.

(Preparation of Yellow Toner Particle Y1): without Addition of Large Particle Diameter External Additive To Colored Particle Y1, 1% by weight of hydrophobic silica having a number average primary particle diameter of 12 nm and a hydrophobic degree of 68 were added and mixed by a Henschel mixer to prepare Yellow Toner Particle Y1. The large particle diameter additive was not added.

(Preparation of Yellow Toner Particle Y2 and Y3): with Addition of the Large Particle Diameter External Additive Yellow Toner Y2 and Y3 were prepared in the same manner as in Yellow Toner Particle Y1 except that the large particle diameter external additive was added in an amount of described in Table 2.

(Preparation of Magenta Toner Particle M1)

To Colored Particle M1, 1% by weight of hydrophobic silica having a number average primary particle diameter of 12 nm and a hydrophobic degree of 68 were added and mixed by a Henschel mixer to prepare Magenta Toner Particle M1. The large particle diameter additive was not added.

(Preparation of Magenta Toner Particle M2 and M3)

Magenta Toner M2 and M3 were prepared in the same manner as in Magenta Toner Particle M1 except that the large particle diameter external additive was added in an amount of described in Table 2.

(Preparation of Cyan Toner Particle C1)

To Colored Particle C1, 1% by weight of hydrophobic silica having a number average primary particle diameter of 12 nm and a hydrophobic degree of 68 were added and mixed by a Henschel mixer to prepare Cyan Toner Particle C1. The large particle diameter additive was not added.

(Preparation of Cyan Toner Particle C2 and C3)

Cyan Toner C2 and C3 were prepared in the same manner as in Cyan Toner Particle C1 except that the large particle diameter external additive was added in an amount of described in Table 2.

(Preparation of Toner Sets 1 through 7)

Thus obtained toner particles were each combined as shown in Table 2 to prepare Toner Sets 1 through 7.

TABLE 2

| Toner | Large particle diameter external additive | | Toner for full color | | | |
|---|---|---|---|---|---|---|
| set | Kind | Primary particle diameter (nm) | Yellow | Magenta | Cyan | Black |
| 1 | Inorganic/organic composite particle 1 | 988 | Y1(0.0) | M1(0.0) | C1(0.0) | Bk1(0.21) |
| 2 | $SrTiO_3$ | 310 | Y1(0.0) | M1(0.0) | C1(0.0) | Bk2(1.2) |
| 3 | $ZnO_2$ | 1482 | Y1(0.0) | M1(0.0) | C1(0.0) | Bk3(1.96) |
| 4 | Sol-gel method silica | 155 | Y1(0.0) | M1(0.0) | C1(0.0) | Bk4(2.77) |
| 5 | Hydroxytalcite | 1890 | Y1(0.0) | M1(0.0) | C1(0.0) | Bk5(0.06) |
| 6 | Inorganic/organic composite particle 1 | 988 | Y2(0.21) | M2(0.21) | C2(0.21) | Bk6(0.21) |
| 7 | Inorganic/organic composite particle 1 | 988 | Y3(2.0) | M3(2.0) | C3(2.0) | Bk7(0.21) |

Toner for full color: The value in ( ) is the content (adding amount) of the large particle diameter external additive.

Among the large particle diameter external additives, the preparation method of Inorganic/organic Composite Particle 1 is described below.

To 100 g of styrene/acryl organic particle having a electric resistance of $6.6\times10^{13}$ Ω·cm, 40 g of hydrophobic titanium oxide treated by tetraoctyl titanate on the surface thereof and having a primary particle diameter of 15 nm was added and mixed by a tabular mixer. And then the mixture was treated for 3 minutes under a condition of the circumference speed of 100 m/second by a hybridizer prepared by modifying a crashing machine, manufactured by Nara Kikai Seisakusho Co., Ltd., to prepare Inorganic/organic Composite particle 1 in which the titanium oxide is fixed onto the surface of the organic fine particle.

The electric resistance of the Inorganic/organic Composite Particle 1 was $8.8\times10^{12}$ Ω·cm.

The other large diameter external additives such as strontium titanate, zinc oxide, sol-gel method silica and hydroxytalcite, each available on the market were employed.

<<Preparation of Developer>>

A ferrite carrier having a volume average particle diameter of 60 μm and coated with silicone resin was mixed with each of the toner particle shown in the toner set of Table 2 to prepare developers (Black Developers Bk1 through Bk7, Yellow Developers T1 through Y3, Magenta Developers M1 through M3 and Cyan Developers 1C through C3) each having a toner concentration of 6%. And Full Color Developer Sets 1 through 7 were prepared corresponding to Toner Sets 1 through 7 listed in Table 2.

<<Evaluation by Practical Printing>>: Full Color Evaluation

Full color images were formed by employing each of Full Color Developer Sets 1 through 7 and an image forming apparatus having the structure displayed in FIG. 2, and the formed images were subjected of the evaluation on the reproducibility of secondary colors, fixing ability on the folded line and filming occurrence.

<<Reproducibility of Secondary Colors>>

The colors of solid images of the secondary colors (red, blue and green) on the first and $100,000^{th}$ printed images were measured by Macbeth Color-Eye 7000, and the color difference between the first and $100,000^{th}$ printed image was calculated according to CMC (2:1) color difference equation and ranked as follows. When the color difference calculated by the CMC (1:2) color difference equation is not more than 5, the variation of the color of the images is acceptable.

A: Color difference of B, G and R were less than 2.

B: Color difference of at least one of B, G and R was not less than 2 and less than 3.5.

C: Color difference of at least one of B, G and R was not less than 3.5 and less than 5.

D: Color difference of at least one of B, G and R was not less than 5.

<<Fixing Ability on Folded Line>>

For evaluation of the strength of the image on the folded line, a fixing ratio on the folded line was measured.

The fixing ratio on the folded line is the ratio of the crumbled toner at the folded portion when the fixed toner image is folded.

A solid image having a image density of 0.8 was folded and rubbed three times by a finger and the image was opened and wiped by JK wiper manufactured by Crecia CO., Ltd., for three times. The fixing ratio on the folded line was calculated from the image densities at the folded portion of the solid image measured before and after the folding by the following equation.

Fixing ratio on folded line(%)=(Image density after folding)/(Image density before folding)×100

The fixing ratio on the folded line was ranked as follows.

A: Not less than 95%

B: 80 to less than 95%

D: Less than 80%

<<Filming on Photoreceptor>>

Occurrence of the filming (contamination on the photoreceptor) is visually judged.

A: No blur was observed on the photoreceptor and the occurrence of the filming is not confirmed.

B: Slight blur was observed on the photoreceptor and the occurrence of the filming is not clearly confirmed.

C: The filming on the photoreceptor was observed a little.

D: Occurrence of the filming could be confirmed.

In the invention, ranks A and B are acceptable for practical use.

Results are listed in Table 3.

TABLE 3

| Developer set | Toner set | Reproducibility of secondary color | Fixing ability on folded line | Filming on photoreceptor |
|---|---|---|---|---|
| 1 | 1 | A | A | A |
| 2 | 2 | A | B | A |
| 3 | 3 | B | B | A |
| 4 | 4 | B | B | A |
| 5 | 5 | B | B | B |
| 6 | 6 | C | D | C |
| 7 | 7 | D | D | D |

Table 3 shows that Developer Sets 1 through 5 are superior to Developer Sets 6 and 7 in the reproducibility of secondary colors and the fixing ability on the folded line of the fixed image and the occurrence of the filming is small.

Example 1-2

Tandem Type (with Intermediate Layer)

The reproducibility of secondary colors and the fixing ability on the folded line of the fixed image and the occurrence of the filming were evaluated in the same manner as in Example 1-1 except that an image forming apparatus displayed in FIG. 4 was employed.

Thus obtained results are listed in Table 4.

TABLE 4

| Developer set | Toner set | Reproducibility of secondary color | Fixing ability on folded line | Filming on photoreceptor |
|---|---|---|---|---|
| 1 | 1 | A | A | A |
| 2 | 2 | A | B | A |
| 3 | 3 | B | B | A |
| 4 | 4 | B | B | A |
| 5 | 5 | B | B | B |
| 6 | 6 | C | D | C |
| 7 | 7 | D | D | D |

Table 4 shows that Developer Sets 1 through 5 are superior to Developer Sets 6 and 7 in the reproducibility of secondary colors and the fixing ability on the folded line of the fixed image and the occurrence of the filming is small.

Example 2-1

Preparation of Toner (Preparation of Black Toner Particle Bk2-1)

Black Toner Particle Bk2-1 was prepared by adding 1.0% by weight of hydrophobic silica having a number average primary particle diameter 12 nm and a hydrophobic degree of 68, 0.3% by weight of hydrophobic titanium oxide having a number average primary particle diameter 20 nm and a hydrophobic degree of 63, and 0.06% by weight zinc stearate as the slipping agent to the above obtained Colored Particle Bk1 and mixing by the Henschel mixer.

(Preparation of Black Toner Particles Bk2-2 Through Bk2-8)

Black Toner Particles Bk2-2 through Bk2-8 were each prepared in the same manner as in Black Toner Particle Bk1 except that the adding amount of zinc stearate was changed as shown in Table 2-1.

(Preparation of Yellow Toner Particle Y2-1)

Yellow Toner Particle Y2-1 was prepared by adding 1.0% by weight of hydrophobic silica having a number average primary particle diameter 12 nm and a hydrophobic degree of 68, 0.3% by weight of hydrophobic titanium oxide having a number average primary particle diameter 20 nm a hydrophobic degree of 63, and 0.2% by weight zinc stearate as the slipping agent to the above obtained Colored Particle Y1 and mixing by the Henschel mixer.

(Preparation of Yellow Toner Particles Y2-2 through Y2-8)

Yellow Toner Particles Y2-2 through Y2-8 were each prepared in the same manner as in Yellow Toner Particle Y1 except that the adding amount of zinc stearate was changed as shown in Table 2-1.

(Preparation of Magenta Toner Particle M2-1)

Yellow Toner Particle Y2-1 was prepared by adding 1.0% by weight of hydrophobic silica having a number average primary particle diameter 12 nm and a hydrophobic degree of 68, 0.3% by weight of hydrophobic titanium oxide having a number average primary particle diameter 20 nm and a hydrophobic degree of 63, and no zinc stearate to the above obtained Colored Particle M1 and mixing by the Henschel mixer.

(Preparation of Magenta Toner Particles M2-2 through M2-8)

Magenta Toner Particles M2-2 through M2-8 were each prepared in the same manner as in magenta Toner Particle M1 except that the adding amount of zinc stearate was changed as shown in Table 2-1.

(Preparation of Cyan Toner Particle C2-1)

Cyan Toner Particle C2-1 was prepared by adding 1.0% by weight of hydrophobic silica having a number average primary particle diameter 12 nm and a hydrophobic degree of 68, 0.3% by weight of hydrophobic titanium oxide having a number average primary particle diameter 20 nm a hydrophobic degree of 63, and no zinc stearate as the slipping agent to the above obtained Colored Particle C1 and mixing by Henschel mixer.

(Preparation or Cyan Toner Particles C2-2 through C2-8)

Cyan Toner Particles C2-2 through C2-8 were each prepared in the same manner as in magenta Toner Particle C1 except that the adding amount of zinc stearate was changed as shown in Table 2-1.

The average of each of circular degree of thus obtained toners was measured. Obtained results are listed in Table 2-1.

TABLE 2-1

| Color of toner | Toner No. | Adding amount of slipping agent (% by weight) | Average value of circular degree |
|---|---|---|---|
| Magenta | M2-1 | 0.00 | 0.966 |
| | M2-2 | 0.00 | 0.963 |
| | M2-3 | 0.02 | 0.969 |
| | M2-4 | 0.00 | 0.958 |
| | M2-5 | 0.00 | 0.971 |
| | M2-6 | 0.10 | 0.980 |
| | M2-7 | 0.00 | 0.951 |
| | M2-8 | 0.02 | 0.961 |
| Cyan | C2-1 | 0.00 | 0.967 |
| | C2-2 | 0.00 | 0.963 |
| | C2-3 | 0.02 | 0.968 |
| | C2-4 | 0.00 | 0.959 |
| | C2-5 | 0.00 | 0.972 |
| | C2-6 | 0.10 | 0.980 |
| | C2-7 | 0.00 | 0.951 |
| | C2-8 | 0.01 | 0.963 |
| Yellow | Y2-1 | 0.20 | 0.965 |
| | Y2-2 | 0.04 | 0.961 |
| | Y2-3 | 0.40 | 0.968 |
| | Y2-4 | 0.03 | 0.955 |
| | Y2-5 | 0.00 | 0.973 |
| | Y2-6 | 0.10 | 0.982 |
| | Y2-7 | 0.50 | 0.950 |
| | Y2-8 | 0.02 | 0.960 |
| Black | Bk2-1 | 0.06 | 0.965 |
| | Bk2-2 | 0.40 | 0.964 |
| | Bk2-3 | 0.06 | 0.968 |
| | Bk2-4 | 0.00 | 0.957 |
| | Bk2-5 | 0.00 | 0.970 |
| | Bk2-6 | 0.10 | 0.979 |
| | Bk2-7 | 0.00 | 0.950 |
| | Bk2-8 | 0.01 | 0.962 |

The toner particles are represented as sets by every numbers, for example, Black Toner Bk2-1, Yellow Toner Y2-1, Magenta Toner M2-1 and Cyan Toner C2-1 were made into a set named as Toner Set 2-1, the other toners are also made into sets named by the same naming system.

<<Preparation of Developer>>

A ferrite carrier having a volume average particle diameter of 60 μm was added to each of the toner particles of the toner sets shown in Table 2 to prepare developers (Black Developers Bk2-1 through Bk2-8, Yellow Developers Y2-1 through Y2-8, Magenta Developers M2-1 through M2-8, and Cyan Developers C2-1 through C2-8) each having a toner concentration of 60%.

<<Printing Evaluation>>

Full color images were formed by employing each of Color Developer Sets 2-1 through 2-8 and an image forming apparatus having the structure displayed in FIG. 2, and the formed images were subjected of the evaluation on the occurrence of white turbidness on the fixed image, the reproducibility of the secondary colors, the life of the image carrier (photoreceptor) and the cleaning property. For evaluation the cleaning property, a cleaning device displayed in FIG. 4 was installed in the image forming apparatus shown in FIG. 2.

<<Occurrence of White Turbidness>>

The degree of the white turbidity was ranked as follows according to the clarity of the image.

The first and 20,000$^{th}$ printed images were projected by a reflection over head projector and the clarity of each of the image was visually evaluated.

The ranking was carried out as follows.

A: The colors showed high clarity without white turbidness.

B: No problem was posed for practical on the view of the usual image. (Slight turbidness was observed.)

D: The occurrence of the white turbidness causes a problem in the practical use.

The ranks A and B are acceptable for practical use in the invention.

<<Reproducibility of Secondary Colors>>

The colors of solid images of the secondary colors (red, blue and green) on the first and 100,000$^{th}$ printed images were measured by Macbeth Color-Eye 7000, and the color difference between the first and 100,000$^{th}$ printed image was calculated according to CMC (2:1) color difference equation and ranked as follows. When the color difference calculated by the CMC (1:2) color difference equation is not more than 5, the variation of the color of the images is acceptable.

A: Color difference of B, G and R were less than 2.

B: Color difference of at least one of B, G and R was not less than 2 and less than 3.5.

C: Color difference of at least one of B, G and R was not less than 3.5 and less than 5.

D: Color difference of at least one of B, G and R was not less than 5.

<<Life of Image Carrier>>: Referred to Also the Filming Occurring Property

The image carrier (photoreceptor surface) was visually observed to judge the occurrence of the filming (adhesion of contamination on the photoreceptor).

A: Occurrence of the filming was not observed after the printing of more than 500,000 sheets.

B: Occurrence of the filming was observed between the printing of more than 300,000 sheets and not more than 500,000 sheets.

C: Occurrence of the filming was observed a little between the printing of more than 200,000 sheets and not more than 300,000 sheets.

D: Occurrence of the filming was clearly observed on the photoreceptor surface at the printing of less than 200,000 sheets.

The ranks A and B are acceptable for practical use in the invention.

<<Evaluation of Cleaning Property>>

The cleaning conditions were set as follows, and the slipping of the toner through the cleaning blade was evaluated (after each of the completion of 100,000 prints and 200,000 prints, a solid white image was continuously copied on 10 sheets of A3 sized paper and the occurrence of slipping of the toner through the cleaning blade was judged.)

A: Filming caused by the toner slipped through the cleaning blade did not occur until 200,000$^{th}$ copy.

B: Filming caused by the toner slipped through the cleaning blade did not occur until 100,000$^{th}$ copy.

D: Filming caused by the toner slipped through the cleaning blade occurred before 100,000 copies.

The cleaning condition was as follows.

Condition of Cleaning Blade

Constitution: An elastic member and a cleaning blade were pasted to a supporting member. The free length "a" of the cleaning blade and the free length "b" of the elastic member were varied as listed in Tables 2 and 3. For fitting the photoreceptor and the cleaning blade, a setting powder was sprayed onto the photoreceptor and the cleaning blade and the photoreceptor was rotated for 1 minute before the stat of image formation. The cleaning conditions were as follows.

Contact angle of the cleaning blade: 20°

Load to cleaning blade (N/m): 25 N/m

Cleaning blade: Thickness t1: 2 mm, hardness: 70°, repulsion elasticity: 60%, manufactured by Hokushin Kogyo Co., Ltd.

Elastic member: The same material as in the cleaning blade, thickness t2: 1.2 mm.

Obtained results are listed in Table 2-2.

TABLE 2-2

| Developer set No. | Toner* | | | | | | | | White turbidity of image | Reproducibility of secondary color | Life of imager carrier | Cleaning property |
|---|---|---|---|---|---|---|---|---|---|---|---|---|
| 2-1 | Y2-1 | (0.2) | M2-1 | (0.0) | C2-1 | (0.0) | Bk2-1 | (0.06) | A | A | A | A |
| 2-2 | Y2-2 | (0.04) | M2-2 | (0.0) | C2-2 | (0.0) | Bk2-2 | (0.4) | B | B | A | A |
| 2-3 | Y2-3 | (0.4) | M2-3 | (0.0) | C2-3 | (0.02) | Bk2-3 | (0.06) | A | B | A | A |
| 2-4 | Y2-4 | (0.03) | M2-4 | (0.02) | C2-4 | (0.02) | Bk2-4 | (0.03) | B | B | B | B |
| 2-5 | Y2-5 | (0.0) | M2-5 | (0.0) | C2-5 | (0.0) | Bk2-5 | (0.0) | B | B | D | D |
| 2-6 | Y2-6 | (0.1) | M2-6 | (0.1) | C2-6 | (0.1) | Bk2-6 | (0.1) | D | D | B | B |
| 2-7 | Y2-7 | (0.5) | M2-7 | (0.0) | C2-7 | (0.0) | Bk2-7 | (0.0) | D | D | D | D |
| 2-8 | Y2-8 | (0.02) | M2-8 | (0.02) | C2-8 | (0.01) | Bk2-8 | (0.01) | D | D | D | D |

Table 2-2 shows that Developer Sets 1 through 4 are superior to Developer Sets 5 through 8 in the occurrence of the white turbidness, the reproducibility of the secondary colors, the life of the image carrier and cleaning property.

Example 2-2

The occurrence of the white turbidness, the reproducibility of the secondary colors, the life of the image carrier and cleaning property were evaluated in the same manner as in Example 2-1 except that the image forming apparatus shown in FIG. 3. Thus obtained results were similar to those of Example 2-1, and Developer Sets 1 through 4 are superior to Developer Sets 5 through 8 in the occurrence of the white turbidness, the reproducibility of the secondary colors, the life of the image carrier and cleaning property.

What is claimed is:

1. An image forming method for forming a full color toner image, comprising: overlaying four color electrostatic image developing toners of black, yellow, magenta and cyan, wherein at least one of the four color electrostatic image developing toners is a toner containing a large diameter external additive in a larger amount and at least one is a toner containing a large diameter external additive in a smaller amount, in which primary particle diameter of the large diameter external additive is from 150 nm to 2,000 nm, content of the large diameter external additive in the toner containing the large diameter external additive in larger amount is from 0.06 to 4.0% by weight and content of the large diameter external additive in the toner containing the large diameter external additive in the smaller amount is not more than 0.05% by weight.

2. The image forming method of claim 1, wherein the primamy particle diameter of the large diameter external additive is from 280 nm to 1,500 nm.

3. The image forming method of claim 1, wherein the large diameter external additive is selected from the group consisting of an inorganic particle, an organic particle and an inorganic/organic composite particle.

4. The image forming method of claim 1, wherein the toner containing the large diameter external additive in the smaller amount is the magenta toner or the cyan toner.

5. The image forming method of claim 1, wherein the toner containing the large diameter external additive in the larger amount is the yellow toner or the black toner.

6. The image forming method of claim 1, wherein the toner containing the large diameter external additive in the larger amount is the black toner.

7. The image forming method of claim 1, wherein the color images are each formed on individual photoreceptors and the images are transferred onto an intermediate transfer member; thereafter the images transferred on the intermediate transfer member are each overlaid on an image receiving material to form the full color toner image.

8. The image forming method of claim 1, wherein color image is formed on the photoreceptor so that the four color toner images are overlaid and then the overlaid color images are collectively transferred onto an image receiving material.

9. The image forming method of claim 1, wherein the four color electrostatic image developing toners each contains no magnetic substance and has an average value of circular degree of each of the toners being from 0.94 to 0.99.

10. An image forming method for forming a full color toner image, comprising: overlaying four color electrostatic image developing toners of black, yellow, magenta and cyan on an image receiving material, wherein at least one of the four color electrostatic image developing toners is a toner containing an external additive slipping agent in a larger amount and at least one is a toner containing the slipping agent in a smaller amount, in which content of the slipping agent in the toner containing the slipping agent in larger amount is from 0.03 to 0.4% by weight and content of the slipping agent in the toner containing the slipping agent in the smaller amount is from 0 to 0.02% by weight.

11. The image forming method of claim 10, wherein the toner containing the slipping agent in the smaller amount is the magenta toner or the cyan toner.

12. The image forming method of claim 10, wherein the toner containing the slipping agent in the larger amount is the yellow toner or the black toner.

13. The image forming method of claim 10, wherein the toner containing the slipping agent in the larger amount is the yellow toner.

14. The image forming method of claim 10, wherein the four color electrostatic image developing toners each contains no magnetic substance and has the average value of circular degree of each of the toners being from 0.94 to 0.99.

15. The image forming method of claim 3, wherein the primary particle diameter of the large diameter external additive is from 280 nm to 1,500 nm, the toner containing the large diameter external additive in the smaller amount is the magenta toner or the cyan toner, and the toner containing the large diameter external additive in the larger amount is the yellow toner or the black toner.

16. The image forming method of claim 15, wherein the toner containing the large diameter external additive in the larger amount is the black toner.

17. The image forming method of claim 10, wherein the slipping agent includes a metal salt of higher fatty acid.

18. The image forming method of claim 17, wherein the toner containing the slipping agent in the smaller amount is the magenta toner or the cyan toner, and the toner containing the slipping agent in the larger amount is the yellow toner or the black toner.

19. The image forming method of claim 18, wherein the toner containing the slipping agent in the larger amount is the yellow toner.

20. The image forming method of claim 19, wherein the four color electrostatic image developing toners each contains no magnetic substance and has the average value of circular degree of each of the toners being from 0.94 to 0.99.

* * * * *